US012351924B2

(12) United States Patent
Sevov et al.

(10) Patent No.: US 12,351,924 B2
(45) Date of Patent: Jul. 8, 2025

(54) ELECTROREDUCTIVE CROSS COUPLING

(71) Applicant: OHIO STATE INNOVATION FOUNDATION, Columbus, OH (US)

(72) Inventors: Christo Sevov, Columbus, OH (US); Taylor Hamby, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 18/166,604

(22) Filed: Feb. 9, 2023

(65) Prior Publication Data

US 2023/0250539 A1 Aug. 10, 2023

Related U.S. Application Data

(60) Provisional application No. 63/308,319, filed on Feb. 9, 2022.

(51) Int. Cl.

| | |
|---|---|
| ***C25B 3/05*** | (2021.01) |
| ***C25B 3/03*** | (2021.01) |
| ***C25B 3/07*** | (2021.01) |
| ***C25B 3/09*** | (2021.01) |
| ***C25B 3/29*** | (2021.01) |

(52) U.S. Cl.

CPC ..... *C25B 3/05* (2021.01); *C25B 3/03* (2021.01); *C25B 3/07* (2021.01); *C25B 3/09* (2021.01); *C25B 3/29* (2021.01)

(58) Field of Classification Search

None

See application file for complete search history.

(56) References Cited

PUBLICATIONS

Fekner et al. Org. Lett. 2006, 8, 22, 5109-5112 (Year: 2006).*
Ramírez-López et al. ACSCatal. 2016, 6, 3955-3964 (Year: 2016).*
Bajo et al., "Oxidative Addition of Aryl Electrophiles to a Prototypical Nickel(0) Complex: Mechanism and Structure/Reactivity Relationships," Organometallics, 2017, vol. 36, pp. 1662-1672.
Beutner et al., "A Process Chemistry Benchmark for sp2-sp3 Cross Couplings," The Journal of Organic Chemistry, 2021, vol. 86, No. 15, pp. 10380-10396.
Boehm et al., "Palladium-catalyzed Chlorocarbonylation of Aryl (pseudo)Halides throug in situ Generation of Carbon Monoxide," Angewandte Chemie International Edition, 2020, vol. 59, No. 41, pp. 17887-17896.
Bunlaksananusorn et al., "t-BuOK-Mediated Hydrophosphination of Functionalized Alkenes: A Novel Synthesis of Chiral P,N- and P,P-Ligands," The Journal of Organic Chemistry, 2004, vol. 69, No. 14, pp. 4595-4601.
Chen et al., "Quaternary Centers via Ni-Catalyzed Cross-Coupling of Tertiary Carboxylic Acids and Aryl Zinc Reagents," Author Manuscript, Angewandte Chemie International Edition English, Feb. 2019, vol. 58, No. 8, pp. 2454-2458.
(Continued)

*Primary Examiner* — Wojciech Haske

(74) *Attorney, Agent, or Firm* — Meunier Carlin & Curfman LLC

(57) ABSTRACT

Disclosed herein are systems and methods for the electrochemical reductive cross-coupling of $sp^2$ and $sp^3$ hybridized carbon atoms. The methods proceed under mild conditions and have a wide substrate tolerance.

20 Claims, 3 Drawing Sheets

(56) References Cited

PUBLICATIONS

Conan et al., "Nickel-catalysed electroreductive coupling of α-halogenoesters with aryl or vinyl halides," Journal of the Chemical Society, Chemical Communications, 1990, vol. 1, pp. 48-49.
Connolly et al., "Preparation and resolution of a modular class of axially chiral quinazoline-containing ligands and their application in asymmetric rhodium-catalyzed olefin hydroboration," Journal of Organic Chemistry, Oct. 2004, vol. 69, No. 20, pp. 6572-6589.
Deng et al., "Size-selective catalysts in five functionalized porous coordination polymers with unsaturated zinc centers," New Journal of Chemistry, 2017, vol. 41, No. 21, pp. 12611-12616.
Diccianni et al., "Mechanisms of Nickel-Catalyzed Cross-Coupling Reactions," Trends in Chemistry, 2019, vol. 1, No. 9, pp. 830-844.
Diccianni et al., "Mechanistic Characterization of (Xantphos)Ni(I)-Mediated Alkyl Bromide Activation: Oxidative Addition, Electron Transfer, or Halogen-Atom Abstraction," Journal of the American Chemical Society, Jan. 2019, vol. 141, No. 4, pp. 1788-1796.
Dudnik et al., "Nickel-Catalyzed Coupling Reactions of Alkyl Electrophiles, Including Unactivated Tertiary Halides, to Generate Carbon-Boron Bonds," Author Manuscript, Journal of the American Chemical Society, 2012, vol. 134, No. 25, pp. 10693-10697.
Duvadie et al., "Photoredox Iridium-Nickel Dual Catalyzed Cross-Electrophile Coupling: From a Batch to a Continuous Stirred-Tank Reactor via an Automated Segmented Flow Reactor," Organic Process Research & Development, 2021, vol. 25, No. 10, pp. 2323-2330.
Ge et al., "Controlling First-Row Catalysts: Amination of Aryl and Heteroaryl Chlorides and Bromides with Primary aliphatic Amines Catalyzed by a BINAP-Ligated Single-Component Ni(0) Complex," Journal of the American Chemical Society, 2014, vol. 136, pp. 1617-1627.
Gehrtz et al., "Cross-Coupling of Chloro(hetero)arenes with Thiolates Employing a Ni(0)-Precatalyst," Organic Letters, 2019, vol. 21, No. 1, pp. 50-55.
Hamby et al., "Merging Electrochemically-Active and -Inactive Catalysts for Cross-Electrophile Coupling Reactions of Challenging Aryl and Alkyl Electrophiles," Science, Jan. 6, 2022, 12 pages.
Hamby et al., "Supplemental Data—Merging Electrochemically-Active and -Inactive Catalysts for Cross-Electrophile Coupling Reactions of Challenging Aryl and Alkyl Electrophiles," Science, Jan. 6, 2022, pp. S1-S120.
Huang et al., "Expanding Pd-Catalyzed C—N Bond-Forming Processes: The First Amidation of Aryl Sulfonates, Aqueous Amination, and Complementarity with Cu-Catalyzed Reactions," Journal of the American Chemical Society, 2003, vol. 125, No. 22, pp. 6653-6655.
Joshi-Pangu et al., "Nickel-Catalyzed Kumada Cross-Coupling Reactions of Tertiary Alkylmagnesium Halides and Aryl Bromides/Triflates," Author Manuscript, Journal of the American Chemical Society, Jun. 2011, vol. 133, No. 22, pp. 8478-8481.
Jutand, "Contribution of Electrochemistry to Organometallic Catalysis," Chemical Reviews, 2008, vol. 108, pp. 2300-2347.
Kalvet et al., "When Weaker Can Be Tougher: The Role of Oxidation State (I) in P- vs N-Ligand-Derived Ni-Catalyzed Trifluoromethylthiolation of Aryl Halides," ACS Catalysis, 2017, vol. 7, No. 3, pp. 2126-2132.
Kataoka et al., "Air Stable, Sterically Hindered Ferrocenyl Dialkylphosphines for Palladium-Catalyzed C—C, C—N, and C—O Bond-Forming Cross-Couplings," The Journal of Organic Chemistry, 2002, vol. 67, No. 16, pp. 5553-5566.
Kawamata et al., "Electrochemically Driven, Ni-Catalyzed Aryl Amination: Scope, Mechanism, and Applications," Journal of the American Chemical Society, 2019, vol. 141, pp. 6392-6402.
Kehoe et al., "Reactions of the Ni(0) Compound Ni(PPh3)4 with Unactivated Alkyl Halides: Oxidative Addition Reactions Involving Radical Processes and Nickel(I) Intermediates," Organometallics, 2018, vol. 37, No. 15, pp. 2450-2467.
Kim et al., "Nickel-Catalyzed Cross-Electrophile Coupling of Aryl Chlorides with Primary Alkyl Chlorides," Author Manuscript, Journal of the American Chemical Society, Jun. 2020, vol. 142, No. 22, pp. 9902-9907.
Kim et al., "Pd-Catalyzed Ring-Opening Copolymerization of 2-Aryl-1-methylenecyclopropanes with CO to Afford Polyketones via Alternating Insertion of the Two Monomers and C—C Bond Activation of the Three-Membered Ring," Journal of the American Chemical Society, 2002, vol. 124, No. 5, pp. 762-763.
Kitatani et al., "Stereoselective alkylation of 1-lithiocyclopropyl bromides," Journal of the American Chemical Society, 1975, vol. 97, No. 4, pp. 949-951.
Lappin et al., "The Redox Chemistry of Nickel," Advances in Inorganic Chemistry, 1988, vol. 32, pp. 241-295.
Le et al., "A General Small-Scale Reactor to Enable Standardization and Acceleration of Photocatalytic Reactions," ACS Central Science, 2017, vol. 3, pp. 647-653.
Lin et al., "Experimental Electrochemical Potentials of Nickel Complexes," Synlett, 2021, vol. 32, pp. 1606-1620.
Lin et al., "Monovalent Nickel-Mediated Radical Formation: A Concerted Halogen-Atom Dissociation Pathway Determined by Electroanalytical Studies," Journal of the American Chemical Society, 2021, vol. 143, pp. 14196-14206.
Lippincott et al., "Synthesis of Functionalized 1,3-Butadienes via Pd-Catalyzed Cross-Couplings of Substituted Allenic Esters in Water at Room Temperature," Organic Letters, 2018, vol. 20, No. 16, pp. 4719-4722.
Lohre et al., "Nickel-Catalyzed Cross-Coupling of Aryl Bromides with Tertiary Grignard Reagents Utilizing Donor-Functionalized N-Heterocyclic Carbenes (NHCs)," Chemistry—A European Journal, May 2011, vol. 17, No. 22, pp. 6052-6055.
Lucas et al., "Stereospecific and stereoconvergent cross-couplings between alkyl electrophiles," Nature Reviews Chemistry, Aug. 2017, vol. 1, No. 0065.
Ma et al., "Synthesis and reactivity of a putative biogenetic precursor to tricholomenyns B, C, D and E," Tetrahedron Letters, Apr. 2011, vol. 52, No. 17, pp. 2192-2194.
Malapit et al., "Advances on the Merger of Electrochemistry and Transition Metal Catalysis for Organic Synthesis," Author Manuscript, Chemical Reviews, Feb. 2022, vol. 122, No. 3, pp. 3180-3218.
Nattmann et al., "Ni(4-tBu)stb)3: A Robust 16-Electron Ni(0) Olefin Complex for Catalysis," Organometallics, 2020, vol. 39, pp. 3295-3300.
Nimmagadda et al., "Development and Execution of an Ni(II)-Catalyzed Reductive Cross-Coupling of Substituted 2-Chloropyridine and Ethyl 3-Chloropropanoate," Organic Process Research & Development, 2020, vol. 24, No. 6, pp. 1141-1148.
Palmer et al., "A Comparative Review of Metal-Based Charge Carriers in Nonaqueous Flow Batteries," ChemSusChem, Mar. 2021, vol. 15, No. 5, pp. 1214-1228.
Perkins et al., "Metal-Reductant-Free Electrochemical Nickel-Catalyzed Couplings of Aryl and Alkyl Bromides in Acetonitrile," Organic Process Research & Development, 2019, vol. 23, No. 8, pp. 1746-1751.
Primer et al., "Enabling the Cross-Coupling of Tertiary Organoboron Nucleophiles through Radical-Mediated Alkyl Transfer," Author Manuscript, Journal of the American Chemical Society, 2017, vol. 139, No. 29, pp. 9847-9850.
Qiu et al., "Gold(III)-Catalyzed Hologenation of Aromatic Boronates with N-Halosuccinimides," Organic Letters, 2010, vol. 12, No. 23, pp. 5474-5477.
Rosen et al., "Nickel-Catalyzed Cross-Couplings Involving Carbon-Oxygen Bonds," Author Manuscript, Chemical Reviews, 2011, vol. 111, No. 3, pp. 1346-1416.
Sakai et al., "Cross-Electrophile Coupling of Unactivated Alkyl Chlorides," Author Manuscript, Journal of the American Chemical Society, 2020, vol. 142, No. 27, pp. 11691-11697.
Sandford et al., "A synthetic chemist's guide to electroanalytical tools for studying reaction mechanisms," Chemical Science, 2019, vol. 10, pp. 6404-6422.
Somerville et al., "Intermediacy of Ni-Ni Species in sp2 C—O Bond Cleavage of Aryl Esters: Relevance in Catalytic C—Si Bond Formation," Journal of the American Chemical Society, 2018, vol. 140, pp. 8771-8780.

(56) References Cited

PUBLICATIONS

Sun et al., "General Paradigm in Photoredox Ni-Catalyzed Cross-Coupling Allows for Light-Free Access to Reactivity," Angewandte Chemie International Edition, 2020, vol. 59, pp. 9527-9533.
Taylor et al., "Stereospecific Nickel-Catalyzed Cross-Coupling Reactions of Alkyl Ethers: Enantioselective Synthesis of Diarylethanes," Journal of the American Chemical Society, 2011, vol. 133, No. 3, pp. 389-391.
Tian et al., "Metal-free one-pot synthesis of 1, 3-diazaheterocyclic compounds via 12-mediated oxidative C—N bond formation," RSC Advances, vol. 5, No. 76, pp. 62194-62201.
Till et al., "The Application of Pulse Radiolysis to the Study of Ni(I) Intermediates in Ni-Catalyzed Cross-Coupling Reactions," Journal of the American Chemical Society, 2021, vol. 143, No. 25, pp. 9332-9337.
Truesdell et al., "General C(sp2)-C(sp3) Cross-Electrophile Coupling Reactions Enabled by Overcharge Protection of Homogeneous Electrocatalys," Journal of the American Chemical Society, 2020, vol. 142, No. 12, pp. 5884-5893.
Twilton et al., "The merger of transition metal and photocatalysis," Nature Reviews Chemistry, 2017, vol. 1, No. 0052, pp. 1-19.
Wagner et al., "Redox Activity of Pyridine-Oxazoline Ligands in the Stabilization of Low-Valent Organonickel Radical Complexes," Journal of the American Chemical Society, 2021, vol. 143, No. 14, pp. 5295-5300.
Walker et al., "An Electrochemically Promoted, Nickel-Catalyzed Mizoroki-Heck Reaction," ACS Catalysis, 2019, vol. 9, No. 8, pp. 7197-7203.
Wang et al., "Ni-Catalyzed Reductive Coupling of Electron-Rich Aryl Iodides with Tertiary Alkyl Halides," Journal of the American Chemical Society, 2018, vol. 140, No. 43, pp. 14490-14497.
Wang et al., "Nickel-Catalyzed Reductive Coupling of Aryl Bromides with Tertiary Alkyl Halides," Journal of the American Chemical Society, 2015, vol. 137, No. 36, pp. 11562-11565.
Wang et al., "Nickel-Catalyzed Reductive Couplings," Topics in Current Chemistry, 2016, vol. 374, No. 43.
Wang et al., "Quaternary stereocentres via catalytic enantioconvergent nucleophilic substitution reactions of tertiary alkyl halides," Author Manuscript, Nature Chemistry, 2021, vol. 13, pp. 236-242.
Wang et al., "Silver-Mediated Trifluoromethylation of Aryldiazonium Salts: Conversion of Amino Group into Trifluoromethyl Group," Journal of the American Chemical Society, 2013, vol. 135, No. 28, pp. 10330-10333.
Watanabe et al, "A Practical Method for Continuous Production of sp3-Rich Compounds from (Hetero)Aryl Halides and Redox-Active Esters," Chemistry—A European Journal, 2020, vol. 26, pp. 186-191.
Weix, "Methods and Mechanisms for Cross-Electrophile Coupling of Csp2 Halides with Alkyl Electrophiles," Accounts of Chemical Research, 2015, vol. 48, pp. 1767-1775.
Wu et al., "Carbonyl 1,2-transposition through triflate-mediated α-amination," Author Manuscript, Science, 2021, vol. 374, No. 6568, pp. 734-740.
Xu et al., "Overcoming the Naphthyl Requirement in Stereospecific Cross-Couplings to Form Quaternary Stereocenters," Author Manuscript, Journal of the American Chemical Society, 2021, vol. 143, No. 23, pp. 8608-8613.
Xue et al., "Nickel-catalyzed formation of quaternary carbon centers using tertiary alkyl electrophiles," Chemical Society Reviews, 2021, vol. 50, No. 6, pp. 4162-4184.
Yan et al., "Synthetic Organic Electrochemical Methods Since 2000: On the Verge of a Renaissance," Chemical Reviews, Author Manuscript, Nov. 2017, vol. 117, No. 21, pp. 13230-13319.
Yuan et al., "On the Nature of C(sp3)-C(sp2) Bond Formation in Nickel-Catalyzed Tertiary Radical Cross-Couplings: A Case Study of Ni/Photoredox Catalytic Cross-Coupling of Alkyl Radicals and Aryl Halides," Author Manuscript, Journal of the American Chemical Society, 2020, vol. 142, No. 15, pp. 7225-7234.
Yuan et al., "Ru-Catalyzed Selective C—H Bond Hydroxylation of Cyclic Imides," The Journal of Organic Chemistry, 2019, vol. 84, No. 4, pp. 1898-1907.
Yue et al., "Identification of novel small-molecule inhibitors targeting menin-MLL interaction, repurposing the antidiarrheal loperamide," Organic & Biomolecular Chemistry, 2016, vol. 14, No. 36, pp. 8503-8519.
Zhang et al., "Silyl Radical Activation of Alkyl Halides in Metallaphotoredox Catalysis: A Unique Pathway for Cross-Electrophile Coupling," Author Manuscript, Journal of the American Chemical Society, 2016, vol. 138, No. 26, pp. 8084-8087.
Zhao et al., "Ni-Catalyzed Reductive Coupling of Alkyl Acids with Unactivated Tertiary Alkyl and Glycosyl Halides," Journal of the American Chemical Society, 2014, vol. 136, No. 50, pp. 17645-17651.
Zhao et al., "Palladium-Catalyzed Late-Stage Direct Arene Cyanation," Chem, Jan. 10, 2019, vol. 5, pp. 97-107.
Zultanski et al., "Nickel-Catalyzed Carbon-Carbon Bond-Forming Reactions of Unactivated Tertiary Alkyl Halides: Suzuki Arylations," Author Manuscript, Journal of the American Chemical Society, 2013, vol. 135, No. 2, pp. 624-627.

* cited by examiner

ELECTROREDUCTIVE CROSS COUPLING

CROSS-REFERENCE TO RELATED APPLICATION

This application claims the benefit of U.S. Provisional Application 63/308,319, filed on Feb. 9, 2022, the contents of which are hereby incorporated in its entirety.

STATEMENT OF GOVERNMENT SUPPORT

This invention was made with government support under grant/contract number R35 GM138373 awarded by the National Institutes of Health. The government has certain rights in the invention.

FIELD OF THE INVENTION

Disclosed herein are methods of forming carbon-carbon bonds and other bonds using an electrocatalytic process. The process enables the coupling of substrates previously difficult and/or impossible to couple under electroreductive conditions, including tertiary alkyl halides and similar compounds.

BACKGROUND

The development of metal-catalyzed carbon-carbon bond forming reactions has revolutionized synthetic organic chemistry. Because many of these catalytic processes necessitate changes to the oxidation state of the metal, catalysts are generally of noble metals with vetted ligands that facilitate the redox events. To render these transformations favorable, high energy additives are added or substrates are prefunctionalized. There remains a need for improved catalytic systems and processes with mild energy inputs. There remains a need for improved catalytic systems and processes with wide substrate tolerance. There remains a need for improved catalytic systems and processes that do not involve toxic, explosive, or expensive reagents.

DETAILED DESCRIPTION

Figure 1:
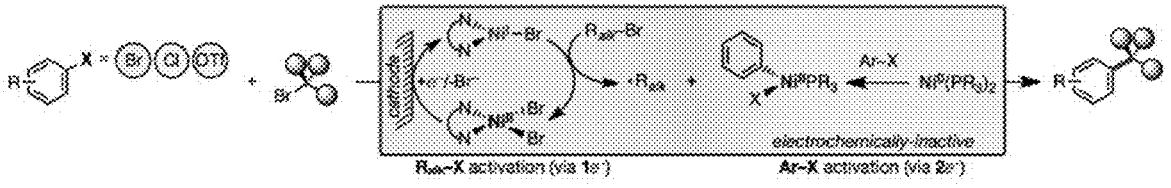
FIG. 1 depicts a schematic depicting an embodiment of the present invention.
Figure 2:
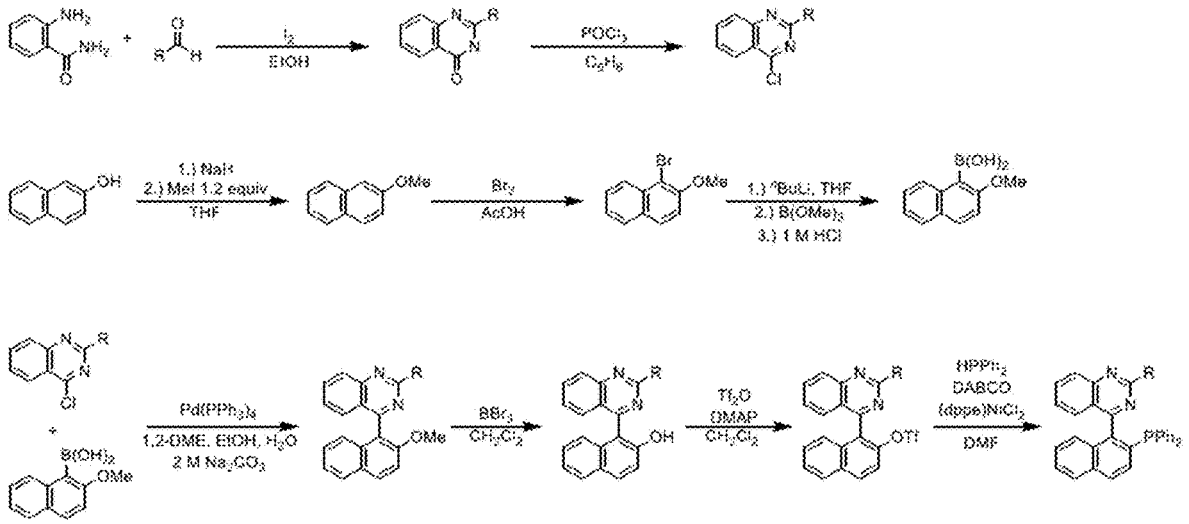
FIG. 2 depicts a scheme for the synthesis of a tertiary organophosphine.
Figure 3:
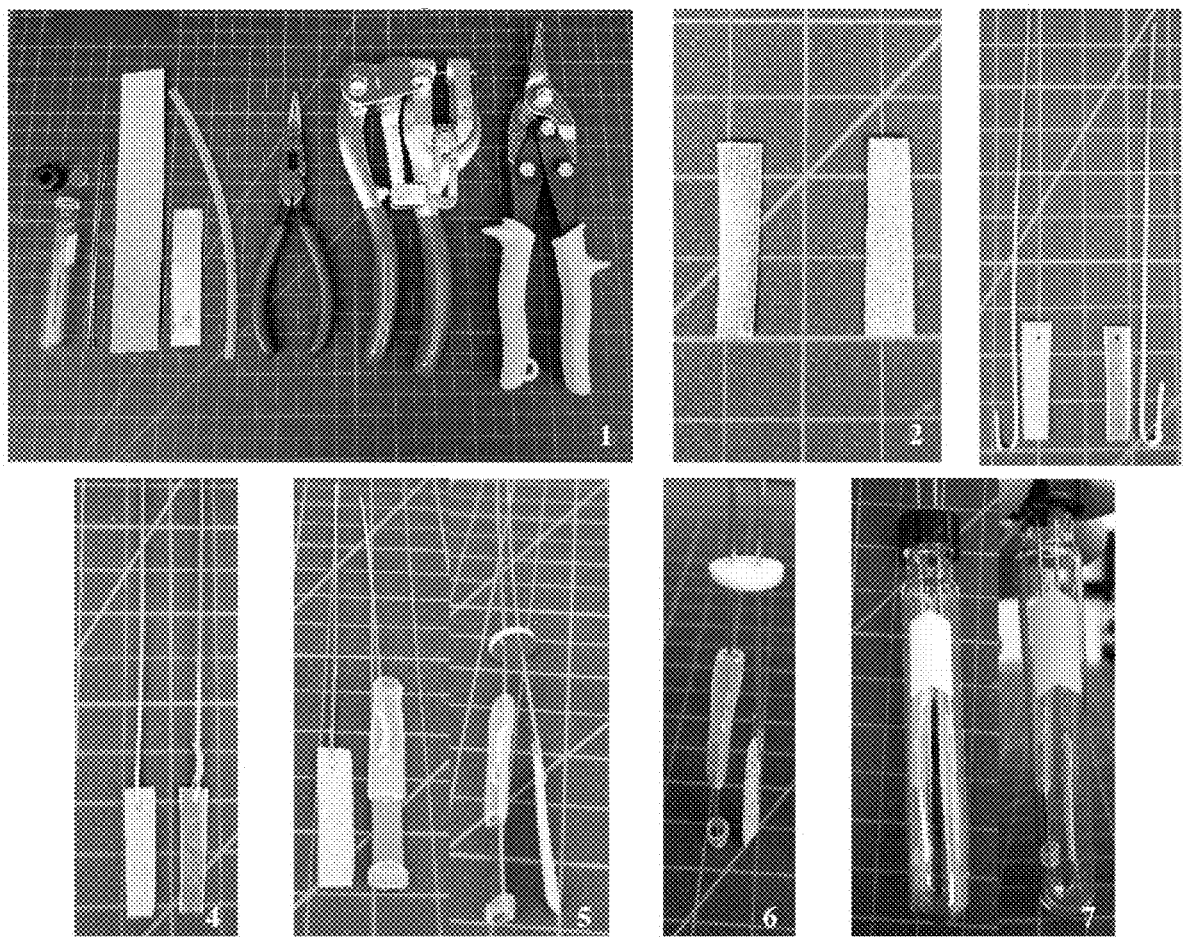
FIG. 3 depicts an assembly of an electrochemical cell.
Figure 4:
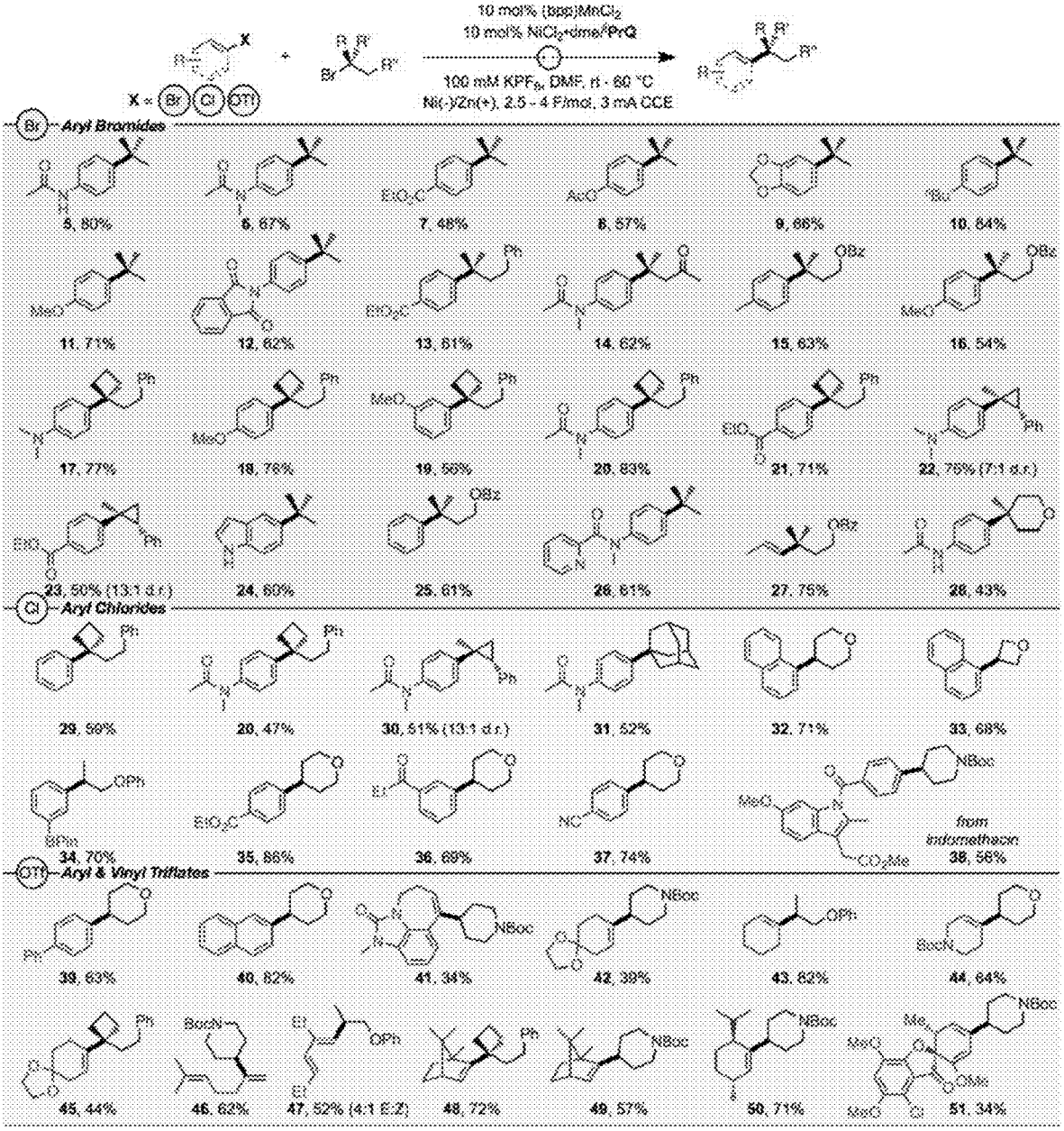
FIG. 4 depicts representative cross coupling reactions.

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes-, from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

When a range of values is listed, it is intended to encompass each value and sub-range within the range. For example, "$C_{1-6}$ alkyl" is intended to encompass $C_1$, $C_2$, $C_3$, $C_4$, $C_5$, $C_6$, $C_{1-6}$, $C_{1-5}$, $C_{1-4}$, $C_{1-3}$, $C_{1-2}$, $C_{2-6}$, $C_{2-5}$, $C_{2-4}$, $C_{2-3}$, $C_{3-6}$, $C_{3-5}$, $C_{3-4}$, $C_{4-6}$, $C_{4-5}$, and $C_{5-6}$ alkyl.

The term "alkyl" refers to a radical of a straight-chain or branched hydrocarbon group having a specified range of carbon atoms (e.g., a "$C_{1-16}$ alkyl" can have from 1 to 16 carbon atoms). Unless specified to the contrary, an "alkyl" group includes both saturated alkyl groups and unsaturated alkyl groups. A saturated alkyl group does not include any carbon-carbon double bonds or carbon-carbon triple bonds. An unsaturated alkyl group contains at least one double or triple carbon-carbon bond. In some embodiments, an alkyl group has 1 to 9 carbon atoms ("$C_{1-9}$ alkyl"). In some embodiments, an alkyl group has 1 to 8 carbon atoms ("$C_{1-8}$ alkyl"). In some embodiments, an alkyl group has 1 to 7 carbon atoms ("$C_{1-7}$ alkyl"). In some embodiments, an alkyl group has 1 to 6 carbon atoms ("$C_{1-6}$ alkyl"). In some embodiments, an alkyl group has 1 to 5 carbon atoms ("$C_{1-5}$ alkyl"). In some embodiments, an alkyl group has 1 to 4 carbon atoms ("$C_{1-4}$ alkyl"). In some embodiments, an alkyl group has 1 to 3 carbon atoms ("$C_{1-3}$ alkyl"). In some embodiments, an alkyl group has 1 to 2 carbon atoms ("$C_{1-2}$ alkyl"). In some embodiments, an alkyl group has 1 carbon atom ("$C_1$ alkyl"). In some embodiments, an alkyl group has 2 to 6 carbon atoms ("$C_{2-6}$ alkyl"). Examples of $C_{1-6}$ saturated alkyl groups include methyl ($C_1$), ethyl ($C_2$), propyl ($C_3$) (e.g., n-propyl, isopropyl), butyl ($C_4$) (e.g., n-butyl, tert-butyl, sec-butyl, iso-butyl), pentyl ($C_5$) (e.g., n-pentyl, 3-pentanyl, amyl, neopentyl, 3-methyl-2-butanyl, tertiary amyl), and hexyl ($C_6$) (e.g., n-hexyl). Additional examples of alkyl groups include n-heptyl ($C_7$), n-octyl ($C_8$), and the like. Unless otherwise specified, each instance of an alkyl group is independently unsubstituted (an "unsubstituted alkyl") or substituted (a "substituted alkyl") with one or more substituents (e.g., halogen, such as F). In certain embodiments, the alkyl group is an unsubstituted $C_{1-10}$ alkyl (such as unsubstituted $C_{1-6}$ alkyl, e.g., —$CH_3$ (Me), unsubstituted ethyl (Et), unsubstituted propyl (Pr, e.g., unsubstituted n-propyl (n-Pr), unsubstituted isopropyl (i-Pr)), unsubstituted butyl (Bu, e.g., unsubstituted n-butyl (n-Bu), unsubstituted tert-butyl (tert-Bu or t-Bu), unsubstituted sec-butyl (sec-Bu), unsubstituted isobutyl (i-Bu)). In certain embodiments, the alkyl group is a substituted $C_{1-10}$ alkyl (such as substituted $C_{1-6}$ alkyl, e.g., —$CF_3$, Bn).

The term "alkylenyl" refers to a divalent radical of a straight-chain, cyclic, or branched saturated hydrocarbon group having a specified range of carbon atoms (e.g., a "$C_{1-16}$ alkyl" can have from 1 to 16 carbon atoms). An example of alkylenyl is a methylene (—$CH_2$—). An alkylenyl can be substituted as described above for an alkyl.

The term "haloalkyl" is a substituted alkyl group, wherein one or more of the hydrogen atoms are independently replaced by a halogen, e.g., fluoro, bromo, chloro, or iodo. In some embodiments, the haloalkyl moiety has 1 to 8 carbon atoms ("$C_{1-8}$ haloalkyl"). In some embodiments, the haloalkyl moiety has 1 to 6 carbon atoms ("$C_{1-6}$ haloalkyl"). In some embodiments, the haloalkyl moiety has 1 to 4 carbon atoms ("$C_{1-4}$ haloalkyl"). In some embodiments, the haloalkyl moiety has 1 to 3 carbon atoms ("$C_{1-3}$ haloalkyl"). In some embodiments, the haloalkyl moiety has 1 to 2 carbon atoms ("$C_{1-2}$ haloalkyl"). Examples of haloalkyl groups include —$CHF_2$, —$CH_2F$, —$CF_3$, —$CH_2CF_3$, —$CF_2CF_3$, —$CF_2CF_2CF_3$, —$CCl_3$, —$CFCl_2$, —$CF_2Cl$, and the like.

The term "hydroxyalkyl" is a substituted alkyl group, wherein one or more of the hydrogen atoms are independently replaced by a hydroxyl. In some embodiments, the hydroxyalkyl moiety has 1 to 8 carbon atoms ("$C_{1-8}$ hydroxyalkyl"). In some embodiments, the hydroxyalkyl moiety has 1 to 6 carbon atoms ("$C_{1-6}$ hydroxyalkyl"). In some embodiments, the hydroxyalkyl moiety has 1 to 4 carbon atoms ("$C_{1-4}$ hydroxyalkyl"). In some embodiments, the hydroxyalkyl moiety has 1 to 3 carbon atoms ("$C_{1-3}$ hydroxyalkyl"). In some embodiments, the hydroxyalkyl moiety has 1 to 2 carbon atoms ("$C_{1-2}$ hydroxyalkyl").

The term "alkoxy" refers to an alkyl group, as defined herein, appended to the parent molecular moiety through an oxygen atom. In some embodiments, the alkoxy moiety has 1 to 8 carbon atoms ("$C_{1-8}$ alkoxy"). In some embodiments, the alkoxy moiety has 1 to 6 carbon atoms ("$C_{1-6}$ alkoxy"). In some embodiments, the alkoxy moiety has 1 to 4 carbon atoms ("$C_{1-4}$ alkoxy"). In some embodiments, the alkoxy moiety has 1 to 3 carbon atoms ("$C_{1-3}$ alkoxy"). In some embodiments, the alkoxy moiety has 1 to 2 carbon atoms ("$C_{1-2}$ alkoxy"). Representative examples of alkoxy include, but are not limited to, methoxy, ethoxy, propoxy, 2-propoxy, butoxy and tert-butoxy.

The term "haloalkoxy" refers to a haloalkyl group, as defined herein, appended to the parent molecular moiety through an oxygen atom. In some embodiments, the alkoxy moiety has 1 to 8 carbon atoms ("$C_{1-8}$ haloalkoxy"). In some embodiments, the alkoxy moiety has 1 to 6 carbon atoms ("$C_{1-6}$ haloalkoxy"). In some embodiments, the alkoxy moiety has 1 to 4 carbon atoms ("$C_{1-4}$ haloalkoxy"). In some embodiments, the alkoxy moiety has 1 to 3 carbon atoms ("$C_{1-3}$ haloalkoxy"). In some embodiments, the alkoxy moiety has 1 to 2 carbon atoms ("$C_{1-2}$ haloalkoxy"). Representative examples of haloalkoxy include, but are not limited to, difluoromethoxy, trifluoromethoxy, and 2,2,2-trifluoroethoxy.

The term "alkoxyalkyl" is a substituted alkyl group, wherein one or more of the hydrogen atoms are independently replaced by an alkoxy group, as defined herein. In some embodiments, the alkoxyalkyl moiety has 1 to 8 carbon atoms ("$C_{1-8}$ alkoxyalkyl"). In some embodiments, the alkoxyalkyl moiety has 1 to 6 carbon atoms ("$C_{1-6}$ alkoxyalkyl"). In some embodiments, the alkoxyalkyl moiety has 1 to 4 carbon atoms ("$C_{1-4}$ alkoxyalkyl"). In some embodiments, the alkoxyalkyl moiety has 1 to 3 carbon atoms ("$C_{1-3}$ alkoxyalkyl"). In some embodiments, the alkoxyalkyl moiety has 1 to 2 carbon atoms ("$C_{1-2}$ alkoxyalkyl").

The term "heteroalkyl" refers to an alkyl group, which further includes at least one heteroatom (e.g., 1, 2, 3, or 4 heteroatoms) selected from oxygen, nitrogen, or sulfur within (i.e., inserted between adjacent carbon atoms of) and/or placed at one or more terminal position(s) of the parent chain. In certain embodiments, a heteroalkyl group refers to a saturated group having from 1 to 20 carbon atoms and 1 or more heteroatoms within the parent chain ("hetero$C_{1-20}$ alkyl"). In some embodiments, a heteroalkyl group is a saturated group having 1 to 18 carbon atoms and 1 or more heteroatoms within the parent chain ("hetero$C_{1-18}$alkyl"). In some embodiments, a heteroalkyl group is a saturated group having 1 to 16 carbon atoms and/or more heteroatoms within the parent chain ("hetero$C_{1-6}$ alkyl"). In some embodiments, a heteroalkyl group is a saturated group having 1 to 14 carbon atoms and 1 or more heteroatoms within the parent chain ("hetero$C_{1-14}$ alkyl"). In some embodiments, a heteroalkyl group is a saturated group having 1 to 12 carbon atoms and 1 or more heteroatoms within the parent chain ("hetero$C_{1-12}$ alkyl"). In some embodiments, a heteroalkyl group is a saturated group having 1 to 10 carbon atoms and 1 or more heteroatoms within the parent chain ("hetero$C_{1-10}$ alkyl"). In some embodiments, a heteroalkyl group is a saturated group having 1 to 8 carbon atoms and 1 or more heteroatoms within the parent chain ("hetero$C_{1-8}$ alkyl"). In some embodiments, a heteroalkyl group is a saturated group having 1 to 6 carbon atoms and 1 or more heteroatoms within the parent chain ("hetero$C_{1-6}$ alkyl"). In some embodiments, a heteroalkyl group is a saturated group having 1 to 4 carbon atoms and 1 or 2 heteroatoms within the parent chain ("hetero$C_{1-4}$ alkyl"). In some embodiments, a heteroalkyl group is a saturated group having 1 to 3 carbon atoms and 1 heteroatom within the parent chain ("hetero$C_{1-3}$ alkyl"). In some embodiments, a heteroalkyl group is a saturated group having 1 to 2 carbon atoms and 1 heteroatom within the parent chain ("hetero$C_{1-2}$ alkyl"). In some embodiments, a heteroalkyl group is a saturated group having 1 carbon atom and 1 heteroatom ("hetero$C_1$ alkyl"). In some embodiments, the heteroalkyl group defined herein is a partially unsaturated group having 1 or more heteroatoms within the parent chain and at least one unsaturated carbon, such as a carbonyl group. For example, a heteroalkyl group may comprise an amide or ester functionality in its parent chain such that one or more carbon atoms are unsaturated carbonyl groups. Unless otherwise specified, each instance of a heteroalkyl group is independently unsubstituted (an "unsubstituted heteroalkyl") or substituted (a "substituted heteroalkyl") with one or more substituents. In certain embodiments, the heteroalkyl group is an unsubstituted hetero$C_{1-20}$ alkyl. In certain embodiments, the heteroalkyl group is an unsubstituted hetero$C_{1-10}$ alkyl. In certain embodiments, the heteroalkyl group is a substituted hetero$C_{1-20}$ alkyl. In certain embodiments, the heteroalkyl group is an unsubstituted hetero$C_{1-10}$ alkyl.

The term "alkenyl" refers to a radical of a straight-chain or branched hydrocarbon group having from 2 to 10 carbon atoms and one or more carbon-carbon double bonds (e.g., 1, 2, 3, or 4 double bonds). In some embodiments, an alkenyl group has 2 to 9 carbon atoms ("$C_{2-9}$ alkenyl"). In some embodiments, an alkenyl group has 2 to 8 carbon atoms ("$C_{2-8}$ alkenyl"). In some embodiments, an alkenyl group has 2 to 7 carbon atoms ("$C_{2-7}$ alkenyl"). In some embodiments, an alkenyl group has 2 to 6 carbon atoms ("$C_{2-6}$ alkenyl"). In some embodiments, an alkenyl group has 2 to 5 carbon atoms ("$C_{2-5}$ alkenyl"). In some embodiments, an alkenyl group has 2 to 4 carbon atoms ("$C_{2-4}$ alkenyl"). In some embodiments, an alkenyl group has 2 to 3 carbon atoms ("$C_{2-3}$ alkenyl"). In some embodiments, an alkenyl group has 2 carbon atoms ("$C_2$ alkenyl"). The one or more carbon-carbon double bonds can be internal (such as in 2-butenyl) or terminal (such as in 1-butenyl). Examples of $C_{2-4}$ alkenyl groups include ethenyl ($C_2$), 1-propenyl ($C_3$), 2-propenyl ($C_3$), 1-butenyl ($C_4$), 2-butenyl ($C_4$), butadienyl ($C_4$), and the like. Examples of $C_{2-6}$ alkenyl groups include the aforementioned $C_{2-4}$ alkenyl groups as well as pentenyl ($C_5$), pentadienyl ($C_5$), hexenyl ($C_6$), and the like. Additional examples of alkenyl include heptenyl ($C_7$), octenyl ($C_8$), octatrienyl ($C_8$), and the like. Unless otherwise specified, each instance of an alkenyl group is independently unsubstituted (an "unsubstituted alkenyl") or substituted (a "substituted alkenyl") with one or more substituents. In certain embodiments, the alkenyl group is an unsubstituted $C_{2-10}$ alkenyl. In certain embodiments, the alkenyl group is a substituted $C_{2-10}$ alkenyl. In an alkenyl group, a C═C double bond for which the stereochemistry is not specified (e.g., —CH═CHCH$_3$ or 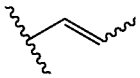 )

may be an (E)- or (Z)-double bond.

The term "heteroalkenyl" refers to an alkenyl group, which further includes at least one heteroatom (e.g., 1, 2, 3, or 4 heteroatoms) selected from oxygen, nitrogen, or sulfur within (i.e., inserted between adjacent carbon atoms of) and/or placed at one or more terminal position(s) of the parent chain. In certain embodiments, a heteroalkenyl group refers to a group having from 2 to 10 carbon atoms, at least one double bond, and 1 or more heteroatoms within the parent chain ("hetero$C_{2-10}$ alkenyl"). In some embodiments, a heteroalkenyl group has 2 to 9 carbon atoms at least one double bond, and 1 or more heteroatoms within the parent chain ("hetero$C_{2-9}$ alkenyl").

In some embodiments, a heteroalkenyl group has 2 to 8 carbon atoms, at least one double bond, and 1 or more heteroatoms within the parent chain ("hetero$C_{2-8}$ alkenyl"). In some embodiments, a heteroalkenyl group has 2 to 7 carbon atoms, at least one double bond, and 1 or more heteroatoms within the parent chain ("hetero$C_{2-7}$ alkenyl"). In some embodiments, a heteroalkenyl group has 2 to 6 carbon atoms, at least one double bond, and 1 or more heteroatoms within the parent chain ("hetero$C_{2-6}$ alkenyl"). In some embodiments, a heteroalkenyl group has 2 to 5 carbon atoms, at least one double bond, and 1 or 2 heteroatoms within the parent chain ("hetero$C_{2-5}$ alkenyl"). In some embodiments, a heteroalkenyl group has 2 to 4 carbon atoms, at least one double bond, and 1 or 2 heteroatoms within the parent chain ("hetero$C_{2-4}$ alkenyl"). In some embodiments, a heteroalkenyl group has 2 to 3 carbon atoms, at least one double bond, and 1 heteroatom within the parent chain ("hetero$C_{2-3}$ alkenyl"). In some embodiments, a heteroalkenyl group has 2 to 6 carbon atoms, at least one double bond, and 1 or 2 heteroatoms within the parent chain ("hetero$C_{2-6}$ alkenyl"). Unless otherwise specified, each instance of a heteroalkenyl group is independently unsubstituted (an "unsubstituted heteroalkenyl") or substituted (a "substituted heteroalkenyl") with one or more substituents. In certain embodiments, the heteroalkenyl group is an unsubstituted hetero$C_{2-10}$ alkenyl. In certain embodiments, the heteroalkenyl group is a substituted hetero$C_{2-10}$ alkenyl.

The term "alkynyl" refers to a radical of a straight-chain or branched hydrocarbon group having from 2 to 10 carbon atoms and one or more carbon-carbon triple bonds (e.g., 1, 2, 3, or 4 triple bonds) ("C2_10 alkynyl"). In some embodiments, an alkynyl group has 2 to 9 carbon atoms ("$C_{2-9}$ alkynyl"). In some embodiments, an alkynyl group has 2 to 8 carbon atoms ("$C_{2-8}$ alkynyl"). In some embodiments, an alkynyl group has 2 to 7 carbon atoms ("$C_{2-7}$ alkynyl"). In some embodiments, an alkynyl group has 2 to 6 carbon atoms ("$C_{2-6}$ alkynyl"). In some embodiments, an alkynyl group has 2 to 5 carbon atoms ("$C_{2-5}$ alkynyl"). In some embodiments, an alkynyl group has 2 to 4 carbon atoms ("$C_{2-4}$ alkynyl"). In some embodiments, an alkynyl group has 2 to 3 carbon atoms ("$C_{2-3}$ alkynyl"). In some embodiments, an alkynyl group has 2 carbon atoms ("$C_2$ alkynyl"). The one or more carbon-carbon triple bonds can be internal (such as in 2-butynyl) or terminal (such as in 1-butynyl). Examples of $C_{2_4}$ alkynyl groups include, without limitation, ethynyl ($C_2$), 1-propynyl ($C_3$), 2-propynyl ($C_3$), 1-butynyl ($C_4$), 2-butynyl ($C_4$), and the like. Examples of $C_{2-6}$ alkenyl groups include the aforementioned $C_{2-4}$ alkynyl groups as well as pentynyl ($C_5$), hexynyl ($C_6$), and the like. Additional examples of alkynyl include heptynyl ($C_7$), octynyl ($C_8$), and the like. Unless otherwise specified, each instance of an alkynyl group is independently unsubstituted (an "unsubstituted alkynyl") or substituted (a "substituted alkynyl") with one or more substituents. In certain embodiments, the alkynyl group is an unsubstituted $C_{2-10}$ alkynyl. In certain embodiments, the alkynyl group is a substituted $C_{2-10}$ alkynyl.

The term "heteroalkynyl" refers to an alkynyl group, which further includes at least one heteroatom (e.g., 1, 2, 3, or 4 heteroatoms) selected from oxygen, nitrogen, or sulfur within (i.e., inserted between adjacent carbon atoms of) and/or placed at one or more terminal position(s) of the parent chain. In certain embodiments, a heteroalkynyl group refers to a group having from 2 to 10 carbon atoms, at least one triple bond, and 1 or more heteroatoms within the parent chain ("hetero$C_{2-10}$ alkynyl"). In some embodiments, a heteroalkynyl group has 2 to 9 carbon atoms, at least one triple bond, and 1 or more heteroatoms within the parent chain ("hetero$C_{2-9}$ alkynyl"). In some embodiments, a heteroalkynyl group has 2 to 8 carbon atoms, at least one triple bond, and 1 or more heteroatoms within the parent chain ("hetero$C_{2-8}$ alkynyl"). In some embodiments, a heteroalkynyl group has 2 to 7 carbon atoms, at least one triple bond, and 1 or more heteroatoms within the parent chain ("hetero$C_{2-7}$ alkynyl"). In some embodiments, a heteroalkynyl group has 2 to 6 carbon atoms, at least one triple bond, and 1 or more heteroatoms within the parent chain ("hetero$C_{2-6}$ alkynyl"). In some embodiments, a heteroalkynyl group has 2 to 5 carbon atoms, at least one triple bond, and 1 or 2 heteroatoms within the parent chain ("hetero$C_{2-5}$ alkynyl"). In some embodiments, a heteroalkynyl group has 2 to 4 carbon atoms, at least one triple bond, and 1 or 2 heteroatoms within the parent chain ("hetero$C_{2-4}$ alkynyl"). In some embodiments, a heteroalkynyl group has 2 to 3 carbon atoms, at least one triple bond, and 1 heteroatom within the parent chain ("hetero$C_{2-3}$ alkynyl"). In some embodiments, a heteroalkynyl group has 2 to 6 carbon atoms, at least one triple bond, and 1 or 2 heteroatoms within the parent chain ("hetero$C_2$-6 alkynyl"). Unless otherwise specified, each instance of a heteroalkynyl group is independently unsubstituted (an "unsubstituted heteroalkynyl") or substituted (a "substituted heteroalkynyl") with one or more substituents. In certain embodiments, the heteroalkynyl group is an unsubstituted hetero$C_{2-10}$ alkynyl. In certain embodiments, the heteroalkynyl group is a substituted hetero$C_{2-10}$ alkynyl.

The term "carbocyclyl" or "carbocyclic" refers to a radical of a non-aromatic cyclic hydrocarbon group having from 3 to 14 ring carbon atoms ("$C_{3-14}$ carbocyclyl") and zero heteroatoms in the non-aromatic ring system. In some embodiments, a carbocyclyl group has 3 to 10 ring carbon atoms ("$C_{3-10}$ carbocyclyl"). In some embodiments, a carbocyclyl group has 3 to 8 ring carbon atoms ("$C_{3-8}$ carbocyclyl"). In some embodiments, a carbocyclyl group has 3 to 7 ring carbon atoms ("$C_{3-7}$ carbocyclyl"). In some embodiments, a carbocyclyl group has 3 to 6 ring carbon atoms ("$C_{3-6}$ carbocyclyl"). In some embodiments, a carbocyclyl group has 4 to 6 ring carbon atoms ("$C_{4-6}$ carbocyclyl"). In some embodiments, a carbocyclyl group has 5 to 6 ring carbon atoms ("$C_{5-6}$ carbocyclyl"). In some embodiments, a carbocyclyl group has 5 to 10 ring carbon atoms ("$C_{5-10}$ carbocyclyl"). Exemplary $C_{3-6}$ carbocyclyl groups include, without limitation, cyclopropyl ($C_3$), cyclopropenyl ($C_3$), cyclobutyl ($C_4$), cyclobutenyl ($C_4$), cyclopentyl ($C_5$), cyclopentenyl ($C_5$), cyclohexyl ($C_6$), cyclohexenyl ($C_6$), cyclohexadienyl ($C_6$), and the like.

Exemplary $C_{3-8}$ carbocyclyl groups include, without limitation, the aforementioned $C_{3-6}$ carbocyclyl groups as well as cycloheptyl ($C_7$), cycloheptenyl ($C_7$), cycloheptadienyl ($C_7$), cycloheptatrienyl ($C_7$), cyclooctyl ($C_8$), cyclooctenyl ($C_8$), bicyclo[2.2.1]heptanyl ($C_7$), bicyclo[2.2.2]octanyl ($C_8$), and the like. Exemplary $C_{3-10}$ carbocyclyl groups include, without limitation, the aforementioned $C_{3-8}$ carbocyclyl groups as well as cyclononyl ($C_9$), cyclononenyl ($C_9$), cyclodecyl ($C_{10}$), cyclodecenyl ($C_{10}$), octahydro-1H-indenyl ($C_9$), decahydronaphthalenyl ($C_{10}$), spiro[4.5]decanyl ($C_{10}$), and the like. As the foregoing examples illustrate, in certain embodiments, the carbocyclyl group is either monocyclic ("monocyclic carbocyclyl") or polycyclic (e.g., containing a fused, bridged or spiro ring system such as a bicyclic system ("bicyclic carbocyclyl") or tricyclic system ("tricyclic carbocyclyl")) and can be saturated or can contain one or more carbon-carbon double or triple bonds. "Carbocyclyl" also includes ring systems wherein the carbocyclyl ring, as defined above, is fused with one or more aryl or heteroaryl groups wherein the point of attachment is on the carbocyclyl ring, and in such instances, the number of carbons continue to designate the number of carbons in the carbocyclic ring system. Unless otherwise specified, each instance of a carbocyclyl group is independently unsubstituted (an "unsubstituted carbocyclyl") or substituted (a "substituted carbocyclyl") with one or more substituents. In certain embodiments, the carbocyclyl group is an unsubstituted $C_{3-14}$ carbocyclyl. In certain embodiments, the carbocyclyl group is a substituted $C_{3-14}$ carbocyclyl.

In some embodiments, "carbocyclyl" is a monocyclic, saturated carbocyclyl group having from 3 to 14 ring carbon atoms ("$C_{3-14}$ cycloalkyl"). In some embodiments, a cycloalkyl group has 3 to 10 ring carbon atoms ("$C_{3-10}$ cycloalkyl"). In some embodiments, a cycloalkyl group has 3 to 8 ring carbon atoms ("$C_{3-8}$ cycloalkyl"). In some embodiments, a cycloalkyl group has 3 to 6 ring carbon atoms ("$C_{3-6}$ cycloalkyl"). In some embodiments, a cycloalkyl group has 4 to 6 ring carbon atoms ("$C_{4-6}$ cycloalkyl"). In some embodiments, a cycloalkyl group has 5 to 6 ring carbon atoms ("$C_{5-6}$ cycloalkyl"). In some embodiments, a cycloalkyl group has 5 to 10 ring carbon atoms ("$C_{5-10}$ cycloalkyl"). Examples of $C_{5-6}$ cycloalkyl groups include cyclopentyl ($C_5$) and cyclohexyl ($C_6$). Examples of $C_{3-6}$ cycloalkyl groups include the aforementioned $C_{5-6}$ cycloalkyl groups as well as cyclopropyl ($C_3$) and cyclobutyl ($C_4$). Examples of $C_{3-8}$ cycloalkyl groups include the aforementioned $C_{3-6}$ cycloalkyl groups as well as cycloheptyl ($C_7$) and cyclooctyl ($C_8$). Unless otherwise specified, each instance of a cycloalkyl group is independently unsubstituted (an "unsubstituted cycloalkyl") or substituted (a "substituted cycloalkyl") with one or more substituents. In certain embodiments, the cycloalkyl group is an unsubstituted $C_{3-14}$ cycloalkyl. In certain embodiments, the cycloalkyl group is a substituted $C_{3-14}$ cycloalkyl.

As used herein, the term "heterocyclyl" refers to an aromatic (also referred to as a heteroaryl), unsaturated, or saturated cyclic hydrocarbon that includes at least one heteroatom in the cycle. For example, the term "heterocyclyl" or "heterocyclic" refers to a radical of a 3- to 14-membered non-aromatic ring system having ring carbon atoms and 1 to 4 ring heteroatoms, wherein each heteroatom is independently selected from nitrogen, oxygen, and sulfur ("3-14 membered heterocyclyl"). In heterocyclyl groups that contain one or more nitrogen atoms, the point of attachment can be a carbon or nitrogen atom, as valency permits. A heterocyclyl group can either be monocyclic ("monocyclic heterocyclyl") or polycyclic (e.g., a fused, bridged or spiro ring system such as a bicyclic system ("bicyclic heterocyclyl") or tricyclic system ("tricyclic heterocyclyl")), and can be saturated or can contain one or more carbon-carbon double or triple bonds. Heterocyclyl polycyclic ring systems can include one or more heteroatoms in one or both rings. "Heterocyclyl" also includes ring systems wherein the heterocyclyl ring, as defined above, is fused with one or more carbocyclyl groups wherein the point of attachment is either on the carbocyclyl or heterocyclyl ring, or ring systems wherein the heterocyclyl ring, as defined above, is fused with one or more aryl or heteroaryl groups, wherein the point of attachment is on the heterocyclyl ring, and in such instances, the number of ring members continue to designate the number of ring members in the heterocyclyl ring system. Unless otherwise specified, each instance of heterocyclyl is independently unsubstituted (an "unsubstituted heterocyclyl") or substituted (a "substituted heterocyclyl") with one or more substituents. In certain embodiments, the heterocyclyl group is an unsubstituted 3-14 membered heterocyclyl. In certain embodiments, the heterocyclyl group is a substituted 3-14 membered heterocyclyl.

In some embodiments, a heterocyclyl group is a 5-10 membered non-aromatic ring system having ring carbon atoms and 1-4 ring heteroatoms, wherein each heteroatom is independently selected from nitrogen, oxygen, and sulfur ("5-10 membered heterocyclyl"). In some embodiments, a heterocyclyl group is a 5-8 membered non-aromatic ring system having ring carbon atoms and 1-4 ring heteroatoms, wherein each heteroatom is independently selected from nitrogen, oxygen, and sulfur ("5-8 membered heterocyclyl"). In some embodiments, a heterocyclyl group is a 5-6 membered non-aromatic ring system having ring carbon atoms and 1-4 ring heteroatoms, wherein each heteroatom is independently selected from nitrogen, oxygen, and sulfur ("5-6 membered heterocyclyl"). In some embodiments, the 5-6 membered heterocyclyl has 1-3 ring heteroatoms selected from nitrogen, oxygen, and sulfur. In some embodiments, the 5-6 membered heterocyclyl has 1-2 ring heteroatoms selected from nitrogen, oxygen, and sulfur. In some embodiments, the 5-6 membered heterocyclyl has 1 ring heteroatom selected from nitrogen, oxygen, and sulfur.

Exemplary 3-membered heterocyclyl groups containing 1 heteroatom include, without limitation, aziridinyl, oxiranyl, and thiiranyl. Exemplary 4-membered heterocyclyl groups containing 1 heteroatom include, without limitation, azetidinyl, oxetanyl, and thietanyl. Exemplary 5-membered heterocyclyl groups containing 1 heteroatom include, without limitation, tetrahydrofuranyl, dihydrofuranyl, tetrahydrothiophenyl, dihydrothiophenyl, pyrrolidinyl, dihydropyrrolyl, and pyrrolyl-2,5-dione. Exemplary 5-membered heterocyclyl groups containing 2 heteroatoms include, without limitation, dioxolanyl, oxathiolanyl and dithiolanyl. Exemplary 5-membered heterocyclyl groups containing 3 heteroatoms include, without limitation, triazolinyl, oxadiazolinyl, and thiadiazolinyl. Exemplary 6-membered heterocyclyl groups containing 1 heteroatom include, without limitation, piperidinyl, tetrahydropyranyl, dihydropyridinyl, and thianyl. Exemplary 6-membered heterocyclyl groups containing 2 heteroatoms include, without limitation, piperazinyl, morpholinyl, dithianyl, and dioxanyl. Exemplary 6-membered heterocyclyl groups containing 3 heteroatoms include, without limitation, triazinyl. Exemplary 7-membered heterocyclyl groups containing 1 heteroatom include, without limitation, azepanyl, oxepanyl and thiepanyl. Exemplary 8-membered heterocyclyl groups containing 1 heteroatom include, without limitation, azocanyl, oxecanyl and thiocanyl. Exemplary bicyclic heterocyclyl groups include, without limitation, indolinyl, isoindolinyl, dihydrobenzofuranyl, dihydrobenzothienyl, tetrahydrobenzothienyl, tetrahydrobenzofuranyl, tetrahydroindolyl, tetrahydroquinolinyl, tetrahydroisoquinolinyl, decahydroquinolinyl, decahydroisoquinolinyl, octahydrochromenyl, octahydroisochromenyl, decahydronaphthyridinyl, decahydro-1,8-naphthyridinyl, octahydropyrrolo[3,2-b]pyrrole, indolinyl, phthalimidyl, naphthalimidyl, chromanyl, chromenyl, 1H-benzo[e][1,4]diazepinyl, 1,4,5,7-tetrahydropyrano[3,4-b]pyrrolyl, 5,6-dihydro-4H-furo[3,2-b]pyrrolyl, 6,7-dihydro-5H furo[3,2-b]pyranyl, 5,7-dihydro-4H-thieno[2,3-c]pyranyl, 2,3-dihydro-1H-pyrrolo[2,3-b]pyridinyl, 2,3-dihydrofuro[2,3-b]pyridinyl, 4,5,6,7-tetrahydro-1H-pyrrolo[2,3-b]pyridinyl, 4,5,6,7-tetrahydrofuro[3,2-c]pyridinyl, 4,5,6,7-tetrahydrothieno[3,2-b]pyridinyl, 1,2,3,4-tetrahydro-1,6-naphthyridinyl, and the like.

The term "aryl" refers to a radical of a monocyclic or polycyclic (e.g., bicyclic or tricyclic) 4n+2 aromatic ring system (e.g., having 6, 10, or 14π electrons shared in a cyclic array) having 6-14 ring carbon atoms and zero heteroatoms provided in the aromatic ring system ("$C_{6-14}$ aryl"). In some embodiments, an aryl group has 6 ring carbon atoms ("$C_6$ aryl"; e.g., phenyl). In some embodiments, an aryl group has 10 ring carbon atoms ("$C_{10}$ aryl"; e.g., naphthyl such as 1-naphthyl and 2-naphthyl). In some embodiments, an aryl group has 14 ring carbon atoms ("$C_{14}$ aryl"; e.g., anthracyl). "Aryl" also includes ring systems wherein the aryl ring, as defined above, is fused with one or more carbocyclyl or heterocyclyl groups wherein the radical or point of attachment is on the aryl ring, and in such instances, the number of carbon atoms continue to designate the number of carbon atoms in the aryl ring system. Unless otherwise specified, each instance of an aryl group is independently unsubstituted (an "unsubstituted aryl") or substituted (a "substituted aryl") with one or more substituents. In certain embodiments, the aryl group is an unsubstituted $C_{6-14}$ aryl. In certain embodiments, the aryl group is a substituted $C_{6-14}$ aryl.

"Aralkyl" is a subset of "alkyl" and refers to an alkyl group substituted by an aryl group, wherein the point of attachment is on the alkyl moiety.

The term "heteroaryl" refers to a radical of a 5-14 membered monocyclic or polycyclic (e.g., bicyclic, tricyclic) 4n+2 aromatic ring system (e.g., having 6, 10, or 14π electrons shared in a cyclic array) having ring carbon atoms and 1-4 ring heteroatoms provided in the aromatic ring system, wherein each heteroatom is independently selected from nitrogen, oxygen, and sulfur ("5-14 membered heteroaryl"). In heteroaryl groups that contain one or more nitrogen atoms, the point of attachment can be a carbon or nitrogen atom, as valency permits. Heteroaryl polycyclic ring systems can include one or more heteroatoms in one or both rings. "Heteroaryl" includes ring systems wherein the heteroaryl ring, as defined above, is fused with one or more carbocyclyl or heterocyclyl groups wherein the point of attachment is on the heteroaryl ring, and in such instances, the number of ring members continue to designate the number of ring members in the heteroaryl ring system. "Heteroaryl" also includes ring systems wherein the heteroaryl ring, as defined above, is fused with one or more aryl groups wherein the point of attachment is either on the aryl or heteroaryl ring, and in such instances, the number of ring members designates the number of ring members in the fused polycyclic (aryl/heteroaryl) ring system. Polycyclic heteroaryl groups wherein one ring does not contain a heteroatom (e.g., indolyl, quinolinyl, carbazolyl, and the like) the point of attachment can be on either ring, i.e., either the ring bearing a heteroatom (e.g., 2-indolyl) or the ring that does not contain a heteroatom (e.g., 5-indolyl).

In some embodiments, a heteroaryl group is a 5-10 membered aromatic ring system having ring carbon atoms and 1-4 ring heteroatoms provided in the aromatic ring system, wherein each heteroatom is independently selected from nitrogen, oxygen, and sulfur ("5-10 membered heteroaryl"). In some embodiments, a heteroaryl group is a 5-8 membered aromatic ring system having ring carbon atoms and 1-4 ring heteroatoms provided in the aromatic ring system, wherein each heteroatom is independently selected from nitrogen, oxygen, and sulfur ("5-8 membered heteroaryl"). In some embodiments, a heteroaryl group is a 5-6 membered aromatic ring system having ring carbon atoms and 1-4 ring heteroatoms provided in the aromatic ring system, wherein each heteroatom is independently selected from nitrogen, oxygen, and sulfur ("5-6 membered heteroaryl"). In some embodiments, the 5-6 membered heteroaryl has 1-3 ring heteroatoms selected from nitrogen, oxygen, and sulfur. In some embodiments, the 5-6 membered heteroaryl has 1-2 ring heteroatoms selected from nitrogen, oxygen, and sulfur. In some embodiments, the 5-6 membered heteroaryl has 1 ring heteroatom selected from nitrogen, oxygen, and sulfur. Unless otherwise specified, each instance of a heteroaryl group is independently unsubstituted (an "unsubstituted heteroaryl") or substituted (a "substituted heteroaryl") with one or more substituents. In certain embodiments, the heteroaryl group is an unsubstituted 5-14 membered heteroaryl. In certain embodiments, the heteroaryl group is a substituted 5-14 membered heteroaryl.

Exemplary 5-membered heteroaryl groups containing 1 heteroatom include, without limitation, pyrrolyl, furanyl, and thiophenyl. Exemplary 5-membered heteroaryl groups containing 2 heteroatoms include, without limitation, imidazolyl, pyrazolyl, oxazolyl, isoxazolyl, thiazolyl, and isothiazolyl. Exemplary 5-membered heteroaryl groups containing 3 heteroatoms include, without limitation, triazolyl, oxadiazolyl, and thiadiazolyl. Exemplary 5-membered heteroaryl groups containing 4 heteroatoms include, without limitation, tetrazolyl. Exemplary 6-membered heteroaryl groups containing 1 heteroatom include, without limitation, pyridinyl. Exemplary 6-membered heteroaryl groups containing 2 heteroatoms include, without limitation, pyridazinyl, pyrimidinyl, and pyrazinyl. Exemplary 6-membered heteroaryl groups containing 3 or 4 heteroatoms include, without limitation, triazinyl and tetrazinyl, respectively. Exemplary 7-membered heteroaryl groups containing 1 heteroatom include, without limitation, azepinyl, oxepinyl, and thiepinyl. Exemplary 5,6-bicyclic heteroaryl groups include, without limitation, indolyl, isoindolyl, indazolyl, benzotriazolyl, benzothiophenyl, isobenzothiophenyl, benzofuranyl, benzoisofuranyl, benzimidazolyl, benzoxazolyl, benzisoxazolyl, benzoxadiazolyl, benzthiazolyl, benzisothiazolyl, benzthiadiazolyl, indolizinyl, and purinyl. Exemplary 6,6-bicyclic heteroaryl groups include, without limitation, naphthyridinyl, pteridinyl, quinolinyl, isoquinolinyl, cinnolinyl, quinoxalinyl, phthalazinyl, and quinazolinyl. Exemplary tricyclic heteroaryl groups include, without limitation, phenanthridinyl, dibenzofuranyl, carbazolyl, acridinyl, phenothiazinyl, phenoxazinyl, and phenazinyl.

"Heteroaralkyl" is a subset of "alkyl" and refers to an alkyl group substituted by a heteroaryl group, wherein the point of attachment is on the alkyl moiety.

Affixing the suffix "-ene" to a group indicates the group is a divalent moiety, e.g., alkylene is the divalent moiety of alkyl, alkenylene is the divalent moiety of alkenyl, alkynylene is the divalent moiety of alkynyl, heteroalkylene is the divalent moiety of heteroalkyl, heteroalkenylene is the divalent moiety of heteroalkenyl, heteroalkynylene is the divalent moiety of heteroalkynyl, carbocyclylene is the divalent moiety of carbocyclyl, heterocyclylene is the divalent moiety of heterocyclyl, arylene is the divalent moiety of aryl, and heteroarylene is the divalent moiety of heteroaryl.

A group is optionally substituted unless expressly provided otherwise. The term "optionally substituted" refers to being substituted or unsubstituted. In certain embodiments, alkyl, alkenyl, alkynyl, heteroalkyl, heteroalkenyl, heteroalkynyl, carbocyclyl, heterocyclyl, aryl, and heteroaryl groups are optionally substituted. "Optionally substituted" refers to a group which may be substituted or unsubstituted (e.g., "substituted" or "unsubstituted" alkyl, "substituted" or "unsubstituted" alkenyl, "substituted" or "unsubstituted" alkynyl, "substituted" or "unsubstituted" heteroalkyl, "substituted" or "unsubstituted" heteroalkenyl, "substituted" or "unsubstituted" heteroalkynyl, "substituted" or "unsubstituted" carbocyclyl, "substituted" or "unsubstituted" heterocyclyl, "substituted" or "unsubstituted" aryl or "substituted" or "unsubstituted" heteroaryl group). In general, the term "substituted" means that at least one hydrogen present on a group is replaced with a permissible substituent, e.g., a substituent which upon substitution results in a stable compound, e.g., a compound which does not spontaneously undergo transformation such as by rearrangement, cyclization, elimination, or other reaction. Unless otherwise indicated, a "substituted" group has a substituent at one or more substitutable positions of the group, and when more than one position in any given structure is substituted, the substituent is either the same or different at each position. The term "substituted" is contemplated to include substitution with all permissible substituents of organic compounds and includes any of the substituents described herein that results in the formation of a stable compound. The present invention contemplates any and all such combinations in order to arrive at a stable compound. For purposes of this invention, heteroatoms such as nitrogen may have hydrogen substituents and/or any suitable substituent as described herein which satisfy the valencies of the heteroatoms and results in the formation of a stable moiety. The invention is not intended to be limited in any manner by the exemplary substituents described herein.

Exemplary carbon atom substituents include, but are not limited to, halogen, —CN, —$NO_2$, —$N_3$, —$SO_2H$, —$SO_3H$, —OH, —$OR^{aa}$, —$ON(R^{bb})_2$, —$N(R^{bb})_2$, —$N(R^{bb})_3{}^+X^-$, —$N(OR^{cc})R^{bb}$, —SH, —$SR^{aa}$, —$SSR^{cc}$, —$C(=O)R^{aa}$, —$CO_2H$, —CHO, —$C(OR^{cc})_3$, —$CO_2R^{aa}$, —$OC(=O)R^{aa}$, —$OCO_2R^{aa}$, —$C(=O)N(R^{bb})_2$, —$OC(=O)N(R^{bb})_2$, —$NR^{bb}C(=O)R^{aa}$, —$NR^{bb}CO_2R^{aa}$, —$NR^{bb}C(=O)N(R^{bb})_2$, —$C(=NR^{bb})R^{aa}$, —$C(=NR^{bb})OR^{aa}$, —$OC(=NR^{bb})R^{aa}$, —$OC(=NR^{bb})OR^{aa}$, —$C(=NR^{bb})N(R^{bb})_2$, —$OC(=NR^{bb})N(R^{bb})_2$, —$NR^{bb}C(=NR^{bb})N(R^{bb})_2$, —$C(=O)NR^{bb}SO_2R^{aa}$, —$NR^{bb}SO_2R^{aa}$, —$SO_2N(R^{bb})_2$, —$SO_2R^{aa}$, —$SO_2OR^{aa}$, —$OSO_2R^{aa}$, —$S(=O)R^{aa}$, —$OS(=O)R^{aa}$, —$Si(R^{aa})_3$, —$OSi(R^{aa})_3$, —$C(=S)N(R^{bb})_2$, —$C(=O)SR^{aa}$, —$C(=S)SR^{aa}$, —$SC(=S)SR^{aa}$, —$SC(=O)SR^{aa}$, —$OC(=O)SR^{aa}$, —$SC(=O)OR^{aa}$, —$SC(=O)R^{aa}$, —$P(=O)(R^{aa})_2$, —$P(=O)(OR^{cc})_2$, —$OP(=O)(R^{aa})_2$, —$OP(=O)(OR^{cc})_2$, —$P(=O)(N(R^{bb})_2)_2$, —$OP(=O)(N(R^{bb})_2)_2$, —$NR^{bb}P(=O)(R^{aa})_2$, —$NR^{bb}P(=O)(OR^{cc})_2$, —$NR^{bb}P(=O)(N(R^{bb})_2)_2$, —$P(R^{cc})_2$, —$P(OR^{cc})_2$, —$P(R^{cc})_3{}^+X^-$, —$P(OR^{aa})_3{}^+X^-$, —$P(R^{cc})_4$, —$P(OR^{cc})_2$, —$OP(R^{cc})_2$, —$OP(R^{aa})_3{}^+X^-$, —$OP(OR^{cc})_2$, —$OP(OR^{cc})_3{}^+X^-$, —$OP(R^{cc})_4$, —$OP(OR^{cc})_4$, —$B(R^{aa})_2$, —$B(OR^{cc})_2$, —$BR^{aa}(OR^{cc})$, $C_{1-10}$ alkyl, $C_{1-10}$ perhaloalkyl, $C_{2-10}$ alkenyl, $C_{2-10}$ alkynyl, hetero$C_{1-10}$ alkyl, hetero$C_{2-10}$ alkenyl, hetero$C_{2-10}$ alkynyl, $C_{3-10}$ carbocyclyl, 3-14 membered heterocyclyl, $C_{6-14}$ aryl, and 5-14 membered heteroaryl, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{dd}$ groups; wherein X is a counterion; or two geminal hydrogens on a carbon atom are replaced with the group =O, =S, =$NN(R^{bb})_2$, =$NNR^{bb}C(=O)R^{aa}$, =$NNR^{bb}C(=O)OR^{aa}$, =$NNR^{bb}S(=O)_2R^{aa}$, =$NR^{bb}$ or =$NOR^{cc}$; each instance of $R^{aa}$ is, independently, selected from $C_{1-10}$ alkyl, $C_{1-10}$ perhaloalkyl, $C_{2-10}$ alkenyl, $C_{2-10}$ alkynyl, hetero$C_{1-10}$ alkyl, hetero$C_{2-10}$ alkenyl, hetero$C_{2-10}$ alkynyl, $C_{3-10}$ carbocyclyl, 3-14 membered heterocyclyl, $C_{6-14}$ aryl, and 5-14 membered heteroaryl, or two $R^{aa}$ groups are joined to form a 3-14 membered heterocyclyl or 5-14 membered heteroaryl ring, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{dd}$ groups; each instance of $R^{bb}$ is, independently, selected from hydrogen, —OH, —$OR^{aa}$, —$N(R^{cc})_2$, —CN, —$C(=O)R^{aa}$, —$C(=O)N(R^{cc})_2$, —$CO_2R^{aa}$, —$SO_2R^{aa}$, —$C(=NR^{cc})OR^{aa}$, —$C(=NR^{cc})N(R^{cc})_2$, —$SO_2N(R^{cc})_2$, —$SO_2R^{cc}$, —$SO_2OR^{cc}$, —$SOR^{aa}$, —$C(=S)N(R^{cc})_2$, —$C(=O)SR^{cc}$, —$C(=S)SR^{cc}$, —$P(=O)(R^{aa})_2$, —$P(=O)(OR^{cc})_2$, —$P(=O)(N(R^{cc})_2)_2$, $C_{1-10}$ alkyl, $C_{1-10}$ perhaloalkyl, $C_{2-10}$ alkenyl, $C_{2-10}$ alkynyl, hetero$C_{1-10}$ alkyl, hetero$C_{2-10}$ alkenyl, hetero$C_{2-10}$ alkynyl, $C_{3-10}$ carbocyclyl, 3-14 membered heterocyclyl, $C_{6-14}$ aryl, and 5-14 membered heteroaryl, or two $R^{bb}$ groups are joined to form a 3-14 membered heterocyclyl or 5-14 membered heteroaryl ring, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{dd}$ groups;

wherein X is a counterion; each instance of $R^{cc}$ is, independently, selected from hydrogen, $C_{1-10}$ alkyl, $C_{1-10}$ perhaloalkyl, $C_{2-10}$ alkenyl, $C_{2-10}$ alkynyl, hetero$C_{1-10}$ alkyl, hetero$C_{2-10}$ alkenyl, hetero$C_{2-10}$ alkynyl, $C_{3-10}$ carbocyclyl, 3-14 membered heterocyclyl, $C_{6-14}$ aryl, and 5-14 membered heteroaryl, or two $R^{cc}$ groups are joined to form a 3-14 membered heterocyclyl or 5-14 membered heteroaryl ring, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{dd}$ groups; each instance of $R^{dd}$ is, independently, selected from halogen, —CN, —$NO_2$, —$N_3$, —$SO_2H$, —$SO_3H$, —OH, —$OR^{ee}$, —$ON(R^{ff})_2$, —$N(R^{ff})_2$, —$N(R^{ff})_3{}^+X^-$, —$N(OR^{ee})R^{ff}$, —SH, —$SR^{ee}$, —$SSR^{ee}$, —$C(=O)R^{ee}$, —$CO_2H$, —$CO_2R^{ee}$, —$OC(=O)R^{ee}$, —$OCO_2R^{ee}$, —$C(=O)N(R^{ff})_2$, —$OC(=O)N(R^{ff})_2$, —$NR^{ff}C(=O)R^{ee}$, —$NR^{ff}CO_2R^{ee}$, —$NR^{ff}C(=O)N(R^{ff})_2$, —$C(=NR^{ff})OR^{ee}$, —$OC(=NR^{ff})R^{ee}$, —$OC(=NR^{ff})OR^{ee}$, —$C(=NR^{ff})N(R^{ff})_2$, —$OC(=NR^{ff})N(R^{ff})_2$, —$NR^{ff}C(=NR^{ff})N(R^{ff})_2$, —$NR^{ff}SO_2R^{ee}$, —$SO_2N(R^{ff})_2$, —$SO_2R^{ee}$, —$SO_2OR^{ee}$, —$OSO_2R^{ee}$, —$S(=O)R^{ee}$, —$Si(R^{ee})_3$, —$OSi(R^{ee})_3$, —$C(=S)N(R^{ff})_2$, —$C(=O)SR^{ee}$, —$C(=S)SR^{ee}$, —$SC(=S)SR^{ee}$, —$P(=O)(OR^{ee})_2$, —$P(=O)(R^{ee})_2$, —$OP(=O)(R^{ee})_2$, —$OP(=O)(OR^{ee})_2$, $C_{1-6}$ alkyl, $C_{1-6}$ perhaloalkyl, $C_{2-6}$ alkenyl, $C_{2-6}$ alkynyl, hetero$C_{1-6}$ alkyl, hetero$C_{2-6}$ alkenyl, hetero$C_{2-6}$ alkynyl, $C_{3-10}$ carbocyclyl, 3-10 membered heterocyclyl, $C_{6-10}$ aryl, 5-10 membered heteroaryl, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{gg}$ groups, or two geminal Rad substituents can be joined to form =O or =S; wherein X is a counterion; each instance of $R^{ee}$ is, independently, selected from $C_{1-6}$ alkyl, $C_{1-6}$ perhaloalkyl, $C_{2-6}$ alkenyl, $C_{2-6}$ alkynyl, hetero$C_{1-6}$ alkyl, hetero$C_{2-6}$ alkenyl, hetero$C_{2-6}$ alkynyl, $C_{3-10}$ carbocyclyl, $C_{6-10}$ aryl, 3-10 membered heterocyclyl, and 3-10 membered heteroaryl, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{gg}$ groups; each instance of $R^{ff}$ is, independently, selected from hydrogen, $C_{1-6}$ alkyl, $C_{1-6}$ perhaloalkyl, $C_{2-6}$ alkenyl, $C_{2-6}$ alkynyl, hetero$C_{1-6}$ alkyl, hetero$C_{2-6}$ alkenyl, hetero$C_{2-6}$ alkynyl, $C_{3-10}$ carbocyclyl, 3-10 membered heterocyclyl, $C_{6-10}$ aryl and 5-10 membered heteroaryl, or two $R^{ff}$ groups are joined to form a 3-10 membered heterocyclyl or 5-10 membered heteroaryl ring, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{gg}$ groups; and each instance of $R^{gg}$ is, independently, halogen, —CN, —$NO_2$, —$N_3$, —$SO_2H$, —$SO_3H$, —OH, —$OC_{1-6}$ alkyl, —$ON(C_{1-6}$ alkyl$)_2$, —$N(C_{1-6}$ alkyl$)_2$, —$N(C_{1-6}$ alkyl$)_3{}^+X^-$, —$NH(C_{1-6}$ alkyl$)_2{}^+X^-$, —$NH_2(C_{1-6}$ alkyl$)^+X^-$, —$NH_3{}^+X^-$, —$N(OC_{1-6}$ alkyl$)(C_{1-6}$ alkyl$)$, —$N(OH)(C_{1-6}$ alkyl$)$, —NH(OH), —SH, —$SC_{1-6}$ alkyl, —$SS(C_{1-6}$ alkyl$)$, —$C(=O)(C_{1-6}$ alkyl$)$, —$CO_2H$, —$CO_2(C_{1-6}$ alkyl$)$, —$OC(=O)(C_{1-6}$ alkyl$)$, —$OCO_2(C_{1-6}$ alkyl$)$, —$C(=O)NH_2$, —$C(=O)N(C_{1-6}$ alkyl$)_2$, —$OC(=O)NH(C_{1-6}$ alkyl$)$, —$NHC(=O)(C_{1-6}$ alkyl$)$, —$N(C_{1-6}$ alkyl$)C(=O)(C_{1-6}$ alkyl$)$, —$NHCO_2(C_{1-6}$ alkyl$)$, —$NHC(=O)N(C_{1-6}$ alkyl$)_2$, —$NHC(=O)NH(C_{1-6}$ alkyl$)$, —$NHC(=O)NH_2$, —$C(=NH)O(C_{1-6}$ alkyl$)$, —$OC(=NH)(C_{1-6}$ alkyl$)$, —$OC(=NH)OC_{1-6}$ alkyl, —$C(=NH)N(C_{1-6}$ alkyl$)_2$, —$C(=NH)NH(C_{1-6}$ alkyl$)$, —$C(=NH)NH_2$, —$OC(=NH)N(C_{1-6}$ alkyl$)_2$, —$OC(=NH)NH(C_{1-6}$ alkyl$)$, —$OC(=NH)NH_2$, —$NHC(=NH)N(C_{1-6}$ alkyl$)_2$, —$NHC(=NH)NH_2$, —$NHSO_2(C_{1-6}$ alkyl$)$, —$SO_2N(C_{1-6}$ alkyl$)_2$, —$SO_2NH(C_{1-6}$ alkyl$)$, —$SO_2NH_2$, —$SO_2(C_{1-6}$ alkyl$)$, —$SO_2O(C_{1-6}$ alkyl$)$, —$OSO_2(C_{1-6}$ alkyl$)$, —$SO(C_{1-6}$ alkyl$)$, —$Si(C_{1-6}$ alkyl$)_3$, —$OSi(C_{1-6}$ alkyl$)_3$, —$C(=S)N(C_{1-6}$ alkyl$)_2$, —$C(=S)NH(C_{1-6}$ alkyl$)$, —$C(=S)NH_2$, —$C(=O)S(C_{1-6}$ alkyl$)$, —$C(=S)SC_{1-6}$ alkyl, —$SC(=S)SC_{1-6}$ alkyl, —$P(=O)(OC_{1-6}$ alkyl$)_2$, —$P(=O)(C_{1-6}$ alkyl$)_2$, —$OP(=O)(C_{1-6}$ alkyl$)_2$, —$OP(=O)(OC_{1-6}$ alkyl$)_2$, $C_{1-6}$ alkyl, $C_{1-6}$ perhaloalkyl, $C_{2-6}$ alkenyl, $C_{2-6}$ alkynyl, hetero$C_{1-6}$ alkyl, hetero$C_{2-6}$ alkenyl, hetero$C_{2-6}$ alkynyl, $C_{3-10}$ carbocyclyl, $C_{6-10}$ aryl, 3-10 membered heterocyclyl, 5-10 membered heteroaryl; or two geminal $R^{gg}$ substituents can be joined to form =O or =S; wherein X is a counterion.

The term "halo" or "halogen" refers to fluorine (fluoro, —F), chlorine (chloro, —Cl), bromine (bromo, —Br), or iodine (iodo, —I).

The term "hydroxyl" or "hydroxy" refers to the group —OH. The term "substituted hydroxyl" or "substituted hydroxyl," by extension, refers to a hydroxyl group wherein the oxygen atom directly attached to the parent molecule is substituted with a group other than hydrogen, and includes groups selected from —$OR^{aa}$, —$ON(R^{bb})_2$, —$OC(=O)SR^{aa}$, —$OC(=O)R^{aa}$, —$OCO_2R^{aa}$, —$OC(=O)N(R^{bb})_2$, —$OC(=NR^{bb})R^{aa}$, —$OC(=NR^{bb})OR^{aa}$, —$OC(=NR^{bb})N(R^{bb})_2$, —$OS(=O)R^{aa}$, —$OSO_2R^{aa}$, —$OSi(R^{aa})_3$, —$OP(R^{cc})_2$, —$OP(R^{aa})_3{}^+X^-$, —$OP(OR^{cc})_2$, —$OP(OR^{cc})_3{}^+X^-$, —$OP(=O)(R^{aa})_2$, —$OP(=O)(OR^{cc})_2$, and —$OP(=O)(N(R^{bb})_2)_2$, wherein $X^-$, $R^{aa}$, $R^{bb}$ and $R^{cc}$ are as defined herein.

The term "amino" refers to the group —$NH_2$. The term "substituted amino," by extension, refers to a monosubstituted amino, a disubstituted amino, or a trisubstituted amino. In certain embodiments, the "substituted amino" is a monosubstituted amino or a disubstituted amino group.

The term "monosubstituted amino" refers to an amino group wherein the nitrogen atom directly attached to the parent molecule is substituted with one hydrogen and one group other than hydrogen, and includes groups selected from —$NH(R^{bb})$, —$NHC(=O)R^{aa}$, —$NHCO_2R^{aa}$, —$NHC(=O)N(R^{bb})_2$, —$NHC(=NR^{bb})N(R^{bb})_2$, —$NHSO_2R^{aa}$, —$NHP(=O)(OR^{cc})_2$, and —$NHP(=O)(N(R^{bb})_2)_2$, wherein $R^{aa}$, $R^{bb}$, and $R^{cc}$ are as defined herein, and wherein $R^{bb}$ of the group —$NH(R^{bb})$ is not hydrogen.

The term "disubstituted amino" refers to an amino group wherein the nitrogen atom directly attached to the parent molecule is substituted with two groups other than hydrogen, and includes groups selected from —$N(R^{bb})_2$, —$NR^{bb}C(=O)R^{aa}$, —$NR^{bb}CO_2R^{aa}$, —$NR^{bb}C(=O)N(R^{bb})_2$, —$NR^{bb}C(=NR^{bb})N(R^{bb})_2$, —$NR^{bb}SO_2R^{aa}$, —$NR^{bb}P(=O)(OR^{cc})_2$, and —$NR^{bb}P(=O)(N(R^{bb})_2)_2$, wherein $R^{aa}$, $R^{bb}$, and $R^{cc}$ are as defined herein, with the proviso that the nitrogen atom directly attached to the parent molecule is not substituted with hydrogen.

The term "trisubstituted amino" refers to an amino group wherein the nitrogen atom directly attached to the parent molecule is substituted with three groups, and includes groups selected from —$N(R^{bb})_2$ and —$N(R^{bb})_3{}^+X^-$, wherein $R^{bb}$ and $X^-$ are as defined herein.

The term "sulfonyl" refers to a group selected from —$SO_2N(R^{bb})_2$, —$SO_2R^{aa}$, and $SO_2OR^{aa}$, wherein $R^{aa}$ and $R^{bb}$ are as defined herein.

The term "sulfinyl" refers to the group —$S(=O)R^{aa}$, wherein $R^{aa}$ is as defined herein.

The term "acyl" refers to a group having the general formula —$C(=O)R^{X1}$, —$C(=O)OR^{X1}$, —$C(=O)$—$O$—$C(=O)R^{X1}$, —$C(=O)SR^{X1}$, —$C(=O)N(R^{X1})_2$, —$C(=S)R^{X1}$, —$C(=S)N(R^{X1})_2$, —$C(=S)O(R^{X1})$, —$C(=S)S(R^{X1})$, —$C(=NR^{X1})R^{X1}$, —$C(=NR^{X1})OR^{X1}$, —$C(=NR^{X1})SR^{X1}$, and —$C(=NR^{X1})N(R^{X1})_2$, wherein $R^{X1}$ is hydrogen; halogen; substituted or unsubstituted hydroxyl; substituted or unsubstituted thiol; substituted or unsubstituted amino; substituted or unsubstituted acyl, cyclic or acyclic, substituted or unsubstituted, branched or unbranched aliphatic; cyclic or acyclic, substituted or unsubstituted, branched or unbranched heteroaliphatic; cyclic or acyclic, substituted or unsubstituted, branched or unbranched alkyl; cyclic or acyclic, substituted or unsubstituted, branched or unbranched alkenyl; substituted or unsubstituted alkynyl; substituted or unsubstituted aryl, substituted or unsubstituted heteroaryl, aliphaticoxy, heteroaliphaticoxy, alkyloxy, heteroalkyloxy, aryloxy, heteroaryloxy, aliphaticthioxy, heteroaliphaticthioxy, alkylthioxy, heteroalkylthioxy, arylthioxy, heteroarylthioxy, mono- or di-aliphaticamino, mono- or di-heteroaliphaticamino, mono- or dialkylamino, mono- or di-heteroalkylamino, mono- or di-arylamino, or mono- or diheteroarylamino; or two $R^{X1}$ groups taken together form a 5- to 6-membered heterocyclic ring.

Exemplary acyl groups include aldehydes (—CHO), carboxylic acids (—$CO_2H$), ketones, acyl halides, esters, amides, imines, carbonates, carbamates, and ureas. Acyl substituents include, butare not limited to, any of the substituents described herein, that result in the formation of a stable moiety (e.g., aliphatic, alkyl, alkenyl, alkynyl, heteroaliphatic, heterocyclic, aryl, heteroaryl, acyl, oxo, imino, thiooxo, cyano, isocyano, amino, azido, nitro, hydroxyl, thiol, halo, aliphaticamino, heteroaliphaticamino, alkylamino, heteroalkylamino, arylamino, heteroarylamino, alkylaryl, arylalkyl, aliphaticoxy, heteroaliphaticoxy, alkyloxy, heteroalkyloxy, aryloxy, heteroaryloxy, aliphaticthioxy, heteroaliphaticthioxy, alkylthioxy, heteroalkylthioxy, arylthioxy, heteroarylthioxy, acyloxy, and the like, each of which may or may not be further substituted).

The term "carbonyl" refers a group wherein the carbon directly attached to the parent molecule is $sp^2$ hybridized, and is substituted with an oxygen, nitrogen or sulfur atom, e.g., a group selected from ketones (e.g., —C(=O)$R^{aa}$), carboxylic acids (e.g., —$CO_2H$), aldehydes(CHO), esters (e.g., —$CO_2R^{aa}$, —C(=O)$SR^{aa}$, —C(=S)$SR^{aa}$), amides (e.g., —C(=O)N$(R^{bb})_2$, C(=O)$NR^{bb}SO_2R^{aa}$, —C(=S)N$(R^{bb})_2$, and imines (e.g., —C(=$NR^{bb}$)$R^{aa}$, —C(=$NR^{bb}$)$OR^{aa}$), C(=$NR^{bb}$)N$(R^{bb})_2$, wherein $R^{aa}$ and $R^{bb}$ are as defined herein.

The term "oxo" refers to the group =O, and the term "thiooxo" refers to the group =S.

The term "cyano" refers to the group —CN.

The term "azide" refers to the group —$N_3$.

Nitrogen atoms can be substituted or unsubstituted as valency permits, and include primary, secondary, tertiary, and quaternary nitrogen atoms. Exemplary nitrogen atom substituents include, but are not limited to, hydrogen, —OH, —$OR^{aa}$, —N$(R^{cc})_2$, —CN, —C(=O)$R^{aa}$, —C(=O)N$(R^{cc})_2$, —$CO_2R^{aa}$, —$SO_2R^{aa}$, —C(=$NR^{bb}$)$R^{aa}$, —C(=$NR^{cc}$)$OR^{aa}$, —C(=$NR^{cc}$)N$(R^{cc})_2$, —$SO_2N(R^{cc})_2$, —$SO_2R^{cc}$, —$SO_2OR^{cc}$, —$SOR^{aa}$, —C(=S)N$(R^{cc})_2$, —C(=O)$SR^{cc}$, —C(=S)$SR^{cc}$, —P(=O)$(OR^{cc})_2$, —P(=O)$(R^{aa})_2$, —P(=O)(N$(R^{cc})_2)_2$, $C_{1-10}$ alkyl, $C_{1-10}$ perhaloalkyl, $C_{2-10}$ alkenyl, $C_{2-10}$ alkynyl, hetero$C_{1-10}$ alkyl, hetero$C_{2-10}$ alkenyl, hetero$C_{2-10}$ alkynyl, $C_{3-10}$ carbocyclyl, 3-14 membered heterocyclyl, $C_{6-14}$ aryl, and 5-14 membered heteroaryl, or two $R^{cc}$ groups attached to an N atom are joined to form a 3-14 membered heterocyclyl or a 5-14 membered heteroaryl ring, wherein each alkyl, alkenyl, alkynyl, heteroalkyl, heteroalkenyl, heteroalkynyl, carbocyclyl, heterocyclyl, aryl, and heteroaryl is independently substituted with 0, 1, 2, 3, 4, or 5 $R^{dd}$ groups, and wherein $R^{aa}$, $R^{bb}$, $R^{cc}$, and $R^{dd}$ are as defined herein.

As used herein, a chemical bond depicted: represents either a single, double, or triple bond, valency permitting. By way of example,

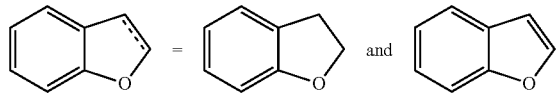

An electron-withdrawing group is a functional group or atom that pulls electron density towards itself, away from other portions of the molecule, e.g., through resonance and/or inductive effects. Exemplary electron-withdrawing groups include F, Cl, Br, I, $NO_2$, CN, $SO_2R$, $SO_3R$, $SO_2NR_2$, C(O)$R^{1a}$; C(O)OR, and C(O)$NR_2$ (wherein R is H or an alkyl, aryl, heteroaryl, cycloalkyl, heterocyclyl group) as well as alkyl group substituted with one or more of those group An electron-donating group is a functional group or atom that pushes electron density away from itself, towards other portions of the molecule, e.g., through resonance and/or inductive effects. Exemplary electron-donating groups include unsubstituted alkyl or aryl groups, OR and $N(R)_2$ and alkyl groups substituted with one or more OR and $N(R)_2$ groups.

Unless stated to the contrary, a formula with chemical bonds shown only as solid lines and not as wedges or dashed lines contemplates each possible isomer, e.g., each enantiomer, diastereomer, and meso compound, and a mixture of isomers, such as a racemic or scalemic mixture. Unless stated to the contrary, a formula depicting one or more stereochemical features does not exclude the presence of other isomers.

Unless stated to the contrary, a substituent drawn without explicitly specifying the point of attachment indicates that the substituent may be attached at any possible atom. For example, in a benzofuran depicted as:

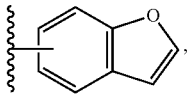

the substituent may be present at any one of the six possible carbon atoms.

As used herein, the term "null," when referring to a possible identity of a chemical moiety, indicates that the group is absent, and the two adjacent groups are directly bonded to one another. By way of example, for a genus of compounds having the formula $CH_3$—X—$CH_3$, if X is null, then the resulting compound has the formula $CH_3$—$CH_3$.

Disclosed herein are processes for forming a compound of Formula (I):

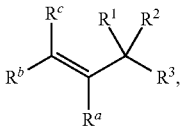

wherein $R^a$ is selected from hydrogen, $C_{1-12}$alkyl, aryl, $C_{1-12}$heteroaryl, $C_{3-12}$cycloalkyl, or $C_{1-12}$heterocyclyl;

wherein $R^b$ is selected from hydrogen, $C_{1-12}$alkyl, aryl, $C_{1-12}$heteroaryl, $C_{3-12}$cycloalkyl, or $C_{1-12}$heterocyclyl;

wherein $R^1$ is selected from hydrogen, $C_{1-12}$alkyl, aryl, $C_{1-12}$heteroaryl, $C_{3-12}$cycloalkyl, or $C_{1-12}$heterocyclyl;

wherein $R^1$ is selected from $C_{1-12}$alkyl, aryl, $C_{1-12}$heteroaryl, $C_{3-12}$cycloalkyl, or $C_{1-12}$heterocyclyl;

wherein $R^2$ is selected from $C_{1-12}$alkyl, aryl, $C_{1-12}$heteroaryl, $C_{3-12}$cycloalkyl, or $C_{1-12}$heterocyclyl;

wherein $R^3$ is selected from hydrogen, $C_{1-12}$alkyl, aryl, $C_{1-12}$heteroaryl, $C_{3-12}$cycloalkyl, or $C_{1-12}$heterocyclyl;

wherein any two or more of $R^a$, $R^b$, $R^c$, $R^1$, $R^2$, and $R^3$ may together form a ring.

The disclosed process includes the step of electrolyzing a mixture to form the compound of Formula (I). The mixture includes the following components:

a) an $sp^2$ donor of Formula (a):

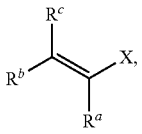

wherein X is F, Cl, Br, I, $OSO_2R$, OC(=O)R, $B(OH)_2$, $BF_3$, $BR_2$, $B(OR)_2$, $B(OC(=O)R)_2$, $B(NHR)_2$, $B(OR)_3$, wherein R is in each case independently selected from $C_{1-8}$alkyl, aryl, $C_{1-8}$cycloalkyl, $C_{1-8}$heterocyclyl, and $C_{1-8}$heteroaryl, each R optionally substituted one or more times by F, Cl, Br, I, $NO_2$, and wherein two or more R groups may together form a ring;

b) an $sp^3$ donor of Formula (b):

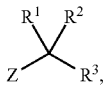

wherein Z is F, Cl, Br, I, $OSO_2R$, OC(=O)R, $B(OH)_2$, $BF_3$, $BR_2$, $B(OR)_2$, $B(OC(=O)R)_2$, $B(NHR)_2$, $B(OR)_3$, wherein R is in each case independently selected from $C_{1-8}$alkyl, aryl, $C_{1-8}$cycloalkyl, $C_{1-8}$heterocyclyl, and $C_{1-8}$heteroaryl, each R optionally substituted one or more times by F, Cl, Br, I, $NO_2$, and wherein two or more R groups may together form a ring; preferably Z is Cl, Br, or I, most preferably Z is Br;

c) a catalyst system comprising:

i) a transition metal selected from Ni, Mn, Fe, Co, Cu, or a combination thereof;

ii) a tridentate ligand; and iii) a tertiary organophosphine.

Suitable tridentate ligands include 2,5-disubstituted pyridine and benzopyridine rings. Typically the substituents are nitrogenous heterocycles so that the tridentate ligand includes at least three Lewis basic sites that can interact with a single metal atom, typically in either the +1 or +2 oxidation state. In some embodiments, tridentate ligand has the formula:

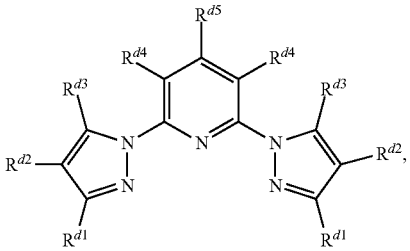

wherein $R^{d1}$ is selected from H, F, Cl, Br, I, $C_{1-3}$alkyl, $C_{1-3}$haloalkyl, $OC_{1-3}$alkyl, $OC_{1-3}$haloalkyl, $R^{d2}$ is selected from H, F, Cl, Br, I, $C_{1-3}$alkyl, $C_{1-3}$haloalkyl, $OC_{1-3}$alkyl, $OC_{1-3}$haloalkyl, $R^{d3}$ is selected from H, F, Cl, Br, I, $C_{1-3}$alkyl, $C_{1-3}$haloalkyl, $OC_{1-3}$alkyl, $OC_{1-3}$haloalkyl, $R^{d4}$ is selected from H, F, Cl, Br, I, $C_{1-3}$alkyl, $C_{1-3}$haloalkyl, $OC_{1-3}$alkyl, $OC_{1-3}$haloalkyl, and $R^{d5}$ is selected from H, F, Cl, Br, I, $C_{1-3}$alkyl, $C_{1-3}$haloalkyl, $OC_{1-3}$alkyl, $OC_{1-3}$haloalkyl, wherein any two or more of $R^{d1}$, $R^{d2}$, $R^{d3}$, $R^{d4}$, and $R^{d5}$ may together form a ring.

In some embodiments, each of $R^{d1}$, $R^{d2}$, $R^{d3}$, $R^{d4}$, and $R^{d5}$ are hydrogen. In some embodiments, $R^{d5}$ is a non-hydrogen substituent, for instance an electron withdrawing or electron donating group. In some embodiments, $R^{d5}$ is F, Cl, Br, $OC_{1-3}$alkyl, $C_{1-3}$alkyl, $OC_{1-3}$haloalkyl, or $C_{1-3}$haloalkyl.

In some embodiments, $R^{d1}$ and/or $R^{d3}$ are non-hydrogen substituents, for instance an electron withdrawing or electron donating group. In some embodiments, $R^{d1}$ is F, Cl, Br, $OC_{1-3}$alkyl, $C_{1-3}$alkyl, $OC_{1-3}$haloalkyl, or $C_{1-3}$haloalkyl, and $R^d$ is hydrogen. In some embodiments, $R^d$ is F, Cl, Br, $OC_{1-3}$alkyl, $C_{1-3}$alkyl, $OC_{1-3}$haloalkyl, or $C_{1-3}$haloalkyl, and $R^{d1}$ is hydrogen. In further embodiments $R^{d1}$ and $R^d$ are independently selected from F, Cl, Br, $OC_{1-3}$alkyl, $C_{1-3}$alkyl, $OC_{1-3}$haloalkyl, or $C_{1-3}$haloalkyl.

Suitable tertiary organophosphines include triaryl phosphines, triheteroaryl phosphines, and mixed aryl/heteroaryl phosphines (e.g., 1 aryl or heteroaryl ring and 2 of the other). In some embodiments, the tertiary organophosphine has the formula:

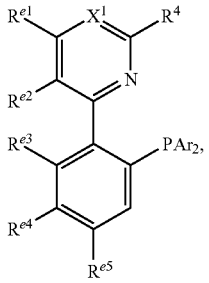

wherein, $X^1$ is N or $CR^5$, wherein $R^5$ is H, $C_{1-4}$alkyl, or $OC_{1-4}$alkyl, Ar is in each case selected from aryl and $C_{1-12}$heteroaryl, $R^4$ is H, $C_{1-8}$alkyl, for example methyl, ethyl, n-propyl, isopropyl, n-butyl, isobutyl, sec-butyl, tert-butyl, n-pentyl, isopentyl, and neopentyl, or $C_{3-8}$cycloalkyl, for example cyclopropyl, cyclobutyl, cyclopentyl, and cyclohexyl;

$R^{e1}$ is selected from H, F, Cl, Br, I, $C_{1-3}$alkyl, $C_{1-3}$haloalkyl, $OC_{1-3}$alkyl, $OC_{1-3}$haloalkyl, $R^{e2}$ is selected from H, F, Cl, Br, I, $C_{1-3}$alkyl, $C_{1-3}$haloalkyl, $OC_{1-3}$alkyl, $OC_{1-3}$haloalkyl, $R^{e3}$ is selected from H, F, Cl, Br, I, $C_{1-3}$alkyl, $C_{1-3}$haloalkyl, $OC_{1-3}$alkyl, $OC_{1-3}$haloalkyl, and $R^{e4}$ is selected from H, F, Cl, Br, I, $C_{1-3}$alkyl, $C_{1-3}$haloalkyl, $OC_{1-3}$alkyl, $OC_{1-3}$haloalkyl, $R^{e5}$ is selected from H, F, Cl, Br, I, $C_{1-3}$alkyl, $C_{1-3}$haloalkyl, $OC_{1-3}$alkyl, $OC_{1-3}$haloalkyl, wherein any two or more of $R^{e1}$, $R^{e2}$, $R^{e3}$, $R^4$, and $R^{e5}$ may together form a ring.

In some preferred embodiments, $X^1$ is N. In instance $R^{e1}$ and $R^{e1}$, as well $R^{e3}$ and $R^{e4}$ can form aromatic rings:

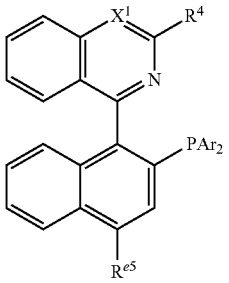

Likewise, $R^{e1}$ and $R^{e1}$, as well $R^{e3}$ and $R^{e4}$ can form heteroaryl, heterocyclyl, or cycloalkyl rings, or $R^{e2}$ and $R^{e3}$ can together form a ring. In some embodiments, Ar is in each case optionally substituted phenyl group, and preferably, Ar is in each case unsubstituted phenyl group.

The scope of compounds of Formula (I) that can be prepared according to the disclosed process is not particularly limited. The $C_{1-12}$alkyl, aryl, $C_{1-12}$heteroaryl, $C_{3-12}$cycloalkyl, or $C_{1-12}$heterocyclyl groups found in each of $R^a$, $R^b$, $R^c$, $R^1$, $R^2$, and $R^3$ may be further substituted one or more times as defined here. The disclosed reaction is compatible with a wide variety of functional and protecting groups. For examples, one or more of $R^a$, $R^b$, $R^c$, $R^1$, $R^2$, and $R^3$ may be substituted one or more times by amides, carbamates, acetals, esters, ethers, ketones, amines (primary, secondary and tertiary amines), ureas, unfunctionalized olefines and acetylenes, and may together form one or more rings. In some embodiments, $R^1$ and $R^2$ may together form a ring, for instance a cyclopropyl ring, a cyclobutyl ring, a cyclopentyl ring, a cyclohexyl ring, etc.

In some embodiments, $R^a$ and $R^b$ will together form a ring, for example an aryl ring or a heteroaryl ring. In some such embodiments, $R^c$ may be hydrogen, but in embodiments, $R^c$ may be a non-hydrogen substituent as defined herein, or may be part of a ring system with one or more of $R^b$, $R^1$, $R^2$, or $R^3$.

In other embodiments, the $sp^2$ donor may appear as part of a styryl type system, e.g., $R^a$ or $R^b$ is an aryl ring, and the other is hydrogen. In such case, $R^c$ is advantageously either hydrogen, $C_{1-3}$alkyl, aryl, or heteroaryl. The process can be conducted intermolecularly when the $sp^2$ donor and the $sp^3$ donor are separate compounds, and can be conducted intramolecularly when the $sp^2$ donor and the $sp^3$ donor are present in the same compound. Intramolecular processes can be used to form sterically congested carbon centers or complex ring systems, both of which frequently appear in complex molecules including some pharmaceuticals. For example, $R^c$ in the $sp^2$ donor may be covalently linked to $R^1$ in the $sp^3$ donor:

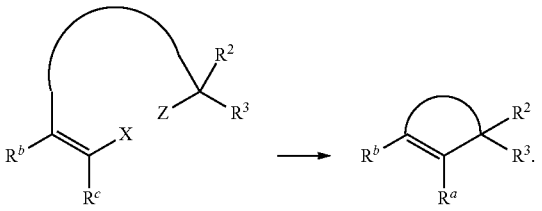

The electroreductive coupling may be performed by supplying an electric current to the mixture. Reaction mixtures may be electrolyzed by supplying an electric current to an electrode, wherein the electrode is in contact with the reaction mixture. Suitable electrodes include those having one or more Ni, Pt, Zn, or Fe metal. In some embodiments the electrode also serves as the source of the transition metal. The electrode may also be a carbon-based electrode like reticulated vitreous carbon, carbon paper, carbon felt, graphite, etc. The carbon-based electrode may also include one or more of the aforementioned metals.

In some embodiments, a current from 0.1-100 mA, from 0.1-50 mA, 0.1-100 mA, from 0.5-50 mA, 0.5-25 mA, from 0.5-15 mA, from 0.5-10 mA, from 0.5-8 mA, from 0.5-6 mA, from 0.5-4 mA, from 0.5-2 mA, from 1-10 mA, from 1-5 mA, from 2-6 mA, from 2-4 mA, or from 2.5-5 mA may be supplied to the mixture.

In some embodiments, the electroreductive coupling is performed by providing from 3-10 equivalent $e^-$, from 3-8 equivalent $e^-$, from 3-6 equivalent $e^-$, from 3.5-6 equivalent $e^-$, from 3.5-5 equivalent $e^-$, from 3.5-4.5 equivalent $e^-$, or from 3.8-4.2 equivalent $e^-$, based on the molar amount of the $sp^3$ donor of Formula (b).

The components of the electroreductive coupling may advantageously be combined in one or more solvents, for example polar aprotic solvents. In some embodiments, the solvent is a weakly coordinating solvent. Exemplary solvents include ethereal solvents, amide-based solvents, ester-based solvents, and the like. Exemplary solvents include THF, DMF, DMSO, HMPA, MeCN, NMP, acetone, methylene chloride, ethyl acetate, glyme, When the $sp^2$ donor and the $sp^3$ donor are separate compounds, they may be combined in the reaction mixture in differing amounts. In some embodiments, the molar ratio of the $sp^3$ donor compound to the $sp^2$ donor compound can be from 1:1 to 1:3, from 1:1 to 1:2.5, from 1:1 to 1:2, from 1:1 to 1:1.5.

The tridentate ligand can be present in an amount of 0.1-25 mol %, 0.5-25 mol %, 1-25 mol %, 2.5-25 mol %, 5-25 mol %, 7.5-25 mol %, 10-25 mol %, 1-20 mol %, 1-15 mol %, 5-15 mol %, 7.5-15 mol %, 0.1-10 mol %, 0.1-5 mol %, 0.1-2.5 mol %, 0.1-1 mol %, 1-10 mol %, 1-7.5 mol %, 1-5 mol %, or 1-2.5 mol %, relative to the $sp^3$ donor.

The tertiary organophosphine can be present in an amount of 0.1-25 mol %, 0.5-25 mol %, 1-25 mol %, 2.5-25 mol %, 5-25 mol %, 7.5-25 mol %, 10-25 mol %, 1-20 mol %, 1-15 mol %, 5-15 mol %, 7.5-15 mol %, 0.1-10 mol %, 0.1-5 mol %, 0.1-2.5 mol %, 0.1-1 mol %, 1-10 mol %, 1-7.5 mol %, 1-5 mol %, or 1-2.5 mol %, relative to the $sp^3$ donor.

In some embodiments, the tridentate ligand and tertiary organophosphine can be present in the same molar amount, while in other embodiments, the tridentate ligand is present in a molar excess relative to the tertiary organophosphine, or the tertiary organophosphine is present in a molar excess relative to the tridentate ligand.

The transition metal can present in an amount of 0.1-25 mol %, 0.5-25 mol %, 1-25 mol %, 2.5-25 mol %, 5-25 mol %, 7.5-25 mol %, 10-25 mol %, 1-20 mol %, 1-15 mol %, 5-15 mol %, 7.5-15 mol %, 0.1-10 mol %, 0.1-5 mol %, 0.1-2.5 mol %, 0.1-1 mol %, 1-10 mol %, 1-7.5 mol %, 1-5 mol %, or 1-2.5 mol %, relative to the $sp^3$ donor.

In some instances, the transition metal includes a mixture of nickel and manganese, for example mixture of nickel and manganese in an equimolar amount. In other embodiments, nickel is essentially the only transition metal in the reaction mixture. The skilled person understands that many transition metal samples contain trace amounts of other metals (less than <1%, <0.5%, <0.1, <0.05, or <0.01). As used herein, a reaction mixture that contains a given transition metal as essentially the only transition metal in the mixture includes mixtures containing trace amounts of other metals. In other embodiments, manganese is the essentially the only transition metal in the reaction mixture.

The transition metals may be provided in the reaction mixture as a salt. Exemplary salts include chloride and bromide salts like $NiCl_2$, $NiBr_2$, $FeBr_2$, $MnCl_2$, $CuCl_2$, $CuBr_2$, $CoCl_2$, $CoBr_2$, as well as carboxylate and sulfonate salts like acetate, tosylate, triflate and the like.

The reaction mixture may further include one or more additional salts, for example salts having a non-coordinating anion such as $PF_6$ and the like. The additional salt may be present in an amount from 0.1 to 10 molar equivalents, 0.1 to 5 molar equivalents, 0.1-2.5 molar equivalents, 0.5-2.5 molar equivalents, or 0.5 to 1.5 molar equivalents, relative to the amount of the $sp^3$ donor.

Preferred X groups include Cl, Br and sulfonates such as $OSO_2CH_3$ (mesylate), $OSO_2CF_3$ (triflate), or $OSO_2C$(4-methylphenyl) (tosylate). In some embodiments, X is a boric acid or ester, or a borane. Exemplary groups include:

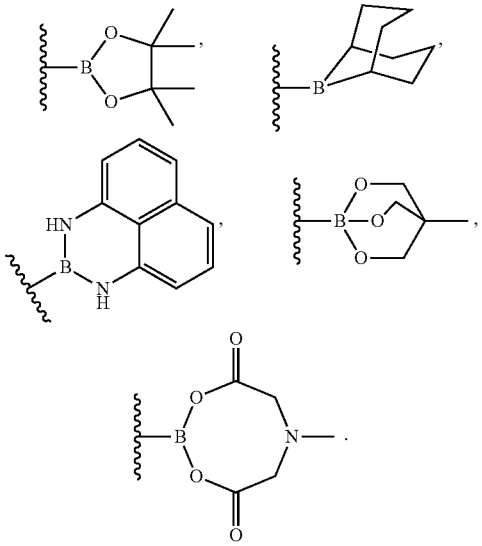

EXAMPLES

The following examples are for the purpose of illustration of the invention only and are not intended to limit the scope of the present invention in any manner whatsoever.

Example 1: Preparation of Electrochemical Cell

The following materials can be used to assemble an electrochemical cell: 12 mL threaded reaction test tube, PTFE septa, threaded test tube cap, copper wire (18 ga), nickel foam, zinc sheet, PTFE tubing (3/16" ID, 1/4" OD, 1/32" WT), pliers, hole punch, and aviation snips.

The nickel foam and zinc plate were cut into 6 mm×32 mm strips using aviation strips, and then 1.2 mm holes were made using the hole punch. The nickel foam and zinc strip were fastened to copper wire. For the nickel foam cathode, the copper wire was threaded through hole and the copper was folded back on itself to clamp the nickel foam in place. For the zinc anode, the copper wire was threaded through hole and then twisted over itself to ensure secure connection. In this example, PTFE tubing was used to ensure the electrodes did not contact one another and short circuit. Two segments of PTFE tubing were cut one being 3 cm and the other being 3 mm. The larger segment was placed over the zinc-copper connection and the smaller segment was placed over the other end of the zinc electrode. The copper wire from nickel foam and zinc electrodes was pushed through PTFE septa and the electrodes were positioned parallel to each other to prevent them from touching. The pair of electrodes were located into threaded reaction test tube with a 1 cm gap from the bottom of the test tube, the septa was then secured with the threaded cap. Images of these steps are depicted in FIG. 5.

Example 2: Cross Coupling of Aryl Bromides with Tertiary Alkyl Bromides

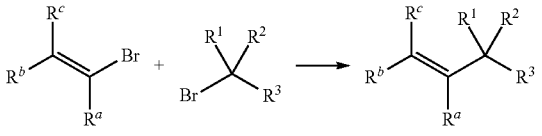

In a nitrogen-filled glove-box, a 4 mL screw-cap vial was charged with (dme)$NiCl_2$ (11 mg, 0.050 mmol, 0.10 equiv), (bpp)$MnCl_2$ (17 mg, 0.050 mmol, 0.10 equiv), dimethylformamide (0.5 mL), and a stir bar. To a separate 4 mL screw-cap vial was charged iPrQ (24 mg, 0.05 mmol, 0.1 equiv), dimethylformamide (0.5 mL), and a stir bar. To a 4 mL screw-cap vial was charged $KPF_6$ (46 mg, 0.25 mmol, 100 mM), aryl bromide (1.00 mmol, 2.00 equiv), alkyl bromide (0.500 mmol, 1.00 equiv), dimethylformamide (1.5 mL), and a magnetic stir bar. These solutions were allowed to stir at room temperature for 10 minutes before transferring to a 12 mL screw-cap vial equipped with a septum. A Ni foam cathode and a Zn anode were inserted into the test tube and the leads were pierced through a septum cap. The sealed test tube was removed from the glovebox. The reaction mixture was stirred on a magnetic stir plate at room temperature for 5 minutes prior to electrolysis. A reductive, constant current was applied at the Ni cathode (3 mA, 53.6 mAh, 4.0 equiv $e^-$). After electrolysis, the product was extracted from the crude reaction mixture with ethyl acetate (3×50 mL) and water (50 mL). The organic layers were combined and washed with brine (50 mL). The organic layer was dried over $Na_2SO_4$, filtered, and concentrated by rotary evaporation. The product was purified by flash chromatography on silica gel.

Example 3: Cross Coupling of Aryl Chlorides with Secondary Alkyl Bromides

In a nitrogen-filled glove-box, a 4 mL screw-cap vial was charged with (dme)$NiCl_2$ (11 mg, 0.050 mmol, 0.10 equiv), (bpp)$NiCl_2$ (18 mg, 0.050 mmol, 0.10 equiv), dimethylformamide (0.5 mL), and a stir bar. To a separate 4 mL screw-cap vial was charged iPrQ (24 mg, 0.05 mmol, 0.1 equiv), dimethylformamide (0.5 mL), and a stir bar. To a 4 mL screw-cap vial was charged $KPF_6$ (46 mg, 0.25 mmol, 100 mM), aryl chloride (1.00 mmol, 2.00 equiv), alkyl bromide (0.500 mmol, 1.00 equiv), dimethylformamide (1.5 mL), and a magnetic stir bar. These solutions were allowed to stir at room temperature for 10 minutes before transferring to a 12 mL screw-cap vial equipped with a septum. A Ni foam cathode and a Zn anode were inserted into the test tube and the leads were pierced through a septum cap. The sealed test tube was removed from the glovebox. The reaction mixture was stirred on a magnetic stir plate at room temperature for 5 minutes prior to electrolysis. A reductive, constant current was applied at the Ni cathode (3 mA, 53.6 mAh, 4.0 equiv $e^-$). After electrolysis, the product was extracted from the crude reaction mixture with ethyl acetate (3×50 mL) and water (50 mL). The organic layers were combined and washed with brine (50 mL). The organic layer was dried over $Na_2SO_4$, filtered, and concentrated by rotary evaporation. The product was purified by flash chromatography on silica gel.

Example 4: Cross Coupling of Aryl and Vinyl Triflates with Alkyl Bromides

In a nitrogen-filled glove-box, a 4 mL screw-cap vial was charged with (dme)$NiCl_2$ (11 mg, 0.050 mmol, 0.10 equiv), (bpp)$NiCl_2$ (18 mg, 0.050 mmol, 0.10 equiv), dimethylformamide (0.5 mL), and a stir bar. To a separate 4 mL screw-cap vial was charged iPrQ (24 mg, 0.05 mmol, 0.1 equiv), dimethylformamide (0.5 mL), and a stir bar. To a 4 mL screw-cap vial was charged $KPF_6$ (46 mg, 0.25 mmol, 100 mM), aryl/vinyl triflate (1.00 mmol, 2.00 equiv), alkyl bromide (0.500 mmol, 1.00 equiv), dimethylformamide (1.5 mL), and a magnetic stir bar. These solutions were allowed to stir at room temperature for 10 minutes before transferring to a 12 mL screw-cap vial equipped with a septum. A Ni foam cathode and a Zn anode were inserted into the test tube and the leads were pierced through a septum cap. The sealed test tube was removed from the glovebox. The reaction mixture was stirred on a magnetic stir plate at room temperature for 5 minutes prior to electrolysis. A reductive, constant current was applied at the Ni cathode (3 mA, 53.6 mAh, 4.0 equiv $e^-$). After electrolysis, the product was extracted from the crude reaction mixture with ethyl acetate (3×50 mL) and water (50 mL). The organic layers were combined and washed with brine (50 mL). The organic layer was dried over $Na_2SO_4$, filtered, and concentrated by rotary evaporation. The product was purified by flash chromatography on silica gel.

Example 5: Compounds Prepared

N-(4-(tert-butyl)phenyl)acetamide: Following Example 2, N-(4-bromophenyl)acetamide (214 mg, 1.00 mmol) was allowed to react with $^t$BuBr (68 mg, 0.50 mmol) under reductive electrolysis (3 mA, 4 equiv $e^-$). The title compound was isolated following purification by flash column chromatography (26:74 EtOAc:Hexanes) as a white solid (76 mg, 0.40 mmol, 80%).

N-(4-tert-butylphenyl)-N-methylacetamide: Following Example 2, N-(4-bromophenyl)-N-methylacetamide (231 mg, 1.01 mmol) was allowed to react with $^t$BuBr (68 mg, 0.20 mmol) under reductive electrolysis (3 mA, 4 equiv $e^-$). The title compound was isolated following purification by flash column chromatography (22:78 EtOAc:Hexanes) as an off-white solid (69 mg, 0.34 mmol, 67%).

Ethyl 4-(tert-butyl)benzoate: Following Example 2, ethyl 4-bromobenzoate (227 mg, 0.990 mmol) was allowed to react with $^t$BuBr (68 mg, 0.50 mmol) under reductive electrolysis (3 mA, 4 equiv $e^-$). The title compound was isolated following purification by flash column chromatography (0.5:99.5 EtOAc:Hexanes) as colorless oil (50 mg, 0.24 mmol, 48%).

4-(tert-butyl)phenyl acetate=: Following Example 2, 4-bromophenyl acetate (220 mg, 1.02 mmol) was allowed to react with $^t$BuBr (70 mg, 0.51 mmol) under reductive electrolysis (3 mA, 4 equiv $e^-$). The title compound was isolated following purification by flash column chromatography (2:98 EtOAc:Hexanes) as colorless oil (56 mg, 0.291 mmol, 57%).

5-(tert-butyl)benzo[d][1,3]dioxole: Following Example 2, 5-bromobenzo[d][1,3]dioxole (199 mg, 0.999 mmol) was allowed to react with $^t$BuBr (68 mg, 0.496 mmol) under reductive electrolysis (3 mA, 4 equiv $e^-$). The title compound was isolated following purification by flash column chromatography (2:98 EtOAc:Hexanes) as colorless oil (58 mg, 0.33 mmol, 66%).

1-(tert-butyl)-4-butylbenzene: Following Example 2, 1-bromo-4-butylbenzene (211 mg, 0.990 mmol) was allowed to react with $^t$BuBr (68 mg, 0.50 mmol) under reductive electrolysis (3 mA, 4 equiv e) The title compound was isolated along with a small aryl dehalogenation byproduct following purification by flash column chromatography (0:100 EtOAc:Hexanes) as a colorless oil (79 mg, 0.42 mmol, 84%).

1-(tert-butyl)-4-methoxybenzene: Following Example 2, 1-bromo-4-methoxybenzene (112 mg, 0.995 mmol) was allowed to react with $^t$BuBr (68 mg, 0.50 mmol) under reductive electrolysis (2 mA, 4 equiv $e^-$). The title compound was isolated following purification by flash column chromatography (0:100 EtOAc:Hexanes) as a colorless oil (58 mg, 0.35 mmol, 71%).

2-(4-(tert-butyl)phenyl)isoindoline-1,3-dione: Following Example 2, 2-(4-bromophenyl)isoindoline-1,3-dione (302 mg, 1.00 mmol) was allowed to react with $^t$BuBr (67 mg, 0.49 mmol) under reductive electrolysis (3 mA, 4.0 equiv $e^-$). The title compound was isolated following purification by flash column chromatography (10:90) EtOAc:Hexanes) as light pink solid (86 mg, 0.31 mmol, 62%) with trace amounts of bpp ligand.

Ethyl 4-(2-methyl-4-phenylbutan-2-yl)benzoate: Following Example 2, ethyl 4-bromobenzoate (241 mg, 1.05 mmol) was allowed to react with (3-bromo-3-methylbutyl)benzene (112 mg, 0.493 mmol) under reductive electrolysis (3 mA, 4 equiv $e^-$). The title compound along with its isomers was isolated following purification by flash column chromatography (1:99 EtOAc:Hexanes) as a white solid (9:1 selectivity) (89 mg, 0.30 mmol, 61%).

N-methyl-N-(4-(2-methyl-4-oxopentan-2-yl)phenyl)acetamide: Following Example 2, N-(4-bromophenyl)-N-methylacetamide (229 mg, 1.00 mmol) was allowed to react with 4-bromo-4-methylpentan-2-one (89 mg, 0.50 mmol) under reductive electrolysis (3 mA, 4 equiv $e^-$). The title compound was isolated following purification by flash column chromatography (28:72 EtOAc:Hexanes) as a white solid (76 mg, 0.31 mmol, 62%).

4-methyl-1-phenyl-4-(p-tolyl)pentan-1-one: Following Example 2, 1-bromo-4-methylbenzene (170 mg, 0.994 mmol) was allowed to react with 4-bromo-4-methyl-1-phenylpentan-1-one (127 mg, 0.498 mmol) under reductive electrolysis (3 mA, 4 equiv $e^-$). The title compound was isolated following purification by flash column chromatography (0.5:99.5 EtOAc:Hexanes) as a colorless oil (84 mg, 0.32 mmol, 63%).

3-(4-methoxyphenyl)-3-methylbutyl benzoate: Following Example 3, 1-bromo-4-methoxybenzene (140 mg, 0.752 mmol) was allowed to react with 3-bromo-3-methylbutyl benzoate (136 mg, 0.501 mmol) under reductive electrolysis (2 mA, 4 equiv $e^-$). The title compound was isolated following purification by flash column chromatography (1:99 EtOAc:Hexanes) as a colorless oil (81 mg, 0.27 mmol, 54%).

N,N-dimethyl-4-(1-phenethylcyclobutyl)aniline: Following Example 2, 4-bromo-N,N-dimethylaniline (152 mg, 0.760 mmol) was allowed to react with (2-(1-bromocyclobutyl)ethyl)benzene (121 mg, 0.506 mmol) under reductive electrolysis (3 mA, 4 equiv $e^-$). The title compound was isolated following purification by flash column chromatography (2:98 EtOAc:Hexanes) as a colorless oil (109 mg, 0.390 mmol, 77%).

1-Methoxy-4-(1-phenethylcyclobutyl)benzene: Following Example 2, 1-bromo-4-methoxybenzene (185 mg, 0.989 mmol) was allowed to react with (2-(1-bromocyclobutyl) ethyl)benzene (118 mg, 0.493 mmol) under reductive electrolysis (3 mA, 4 equiv $e^-$). The title compound was isolated following purification by flash column chromatography (1:99 EtOAc:Hexanes) as a colorless oil (102 mg, 0.383 mmol, 76%).

1-Methoxy-3-(1-phenethylcyclobutyl)benzene: Following Example 2, 1-bromo-3-methoxybenzene (189 mg, 1.01 mmol) was allowed to react with (2-(1-bromocyclobutyl) ethyl)benzene (118 mg, 0.493 mmol) under reductive electrolysis (3 mA, 4 equiv $e^-$). The title compound was isolated following purification by flash column chromatography (1:99 EtOAc:Hexanes) as a colorless oil (76 mg, 0.285 mmol, 56%).

N-methyl-N-(4-(1-phenethylcyclobutyl)phenyl)acetamide: Following Example 2, N-(4-bromophenyl)-N-methylacetamide (227 mg, 0.995 mmol) was allowed to react with (2-(1-bromocyclobutyl)ethyl)benzene (120 mg, 0.502 mmol) under reductive electrolysis (3 mA, 4 equiv $e^-$). The title compound was isolated following purification by flash column chromatography (24:76 EtOAc:Hexanes) as a colorless oil (128 mg, 0.412 mmol, 83%).

Ethyl 4-(1-phenethylcyclobutyl)benzoate: Following Example 2, Ethyl-4-bromobenzoate (214 mg, 1.00 mmol) was allowed to react with (2-(1-bromocyclobutyl)ethyl) benzene (120 mg, 0.502 mmol) under reductive electrolysis (3 mA, 4.0 equiv $e^-$). The title compound was isolated following purification by flash column chromatography (1:99) EtOAc:Hexanes) as colorless oil (110 mg, 0.357 mmol, 71%).

N,N-dimethyl-4-(1-methyl-2-phenylcyclopropyl)aniline: Following Example 2, 4-bromo-N,N-dimethylaniline (202 mg, 1.01 mmol) was allowed to react with (2-bromo-2-methylcyclopropyl)benzene (107 mg, 0.507 mmol) under reductive electrolysis (3 mA, 4 equiv $e^-$). The title compound was isolated following purification by flash column chromatography (2:98 EtOAc:Hexanes) as a yellow solid as a mixture of diastereomers 7:1 trans to cis. (97 mg, 0.386 mmol, 76%).

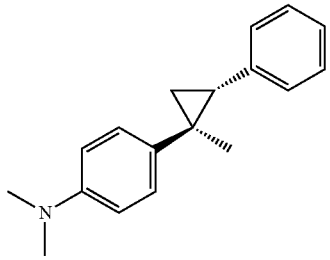

Relative stereochemistry was confirmed by NOESY analysis.

Ethyl 4-(1-methyl-2-phenylcyclopropyl)benzoate: Following a modified Example 2, ethyl 4-bromobenzoate (115 mg, 0.502 mmol) was allowed to react with (2-bromo-2-methylcyclopropyl)benzene (106 mg, 0.502 mmol) under reductive electrolysis (2 mA, 2.5 equiv $e^-$). The title compound was isolated following purification by flash column chromatography (1:99 EtOAc:Hexanes) as a colorless oil (71 mg, 0.25 mmol, 50%).

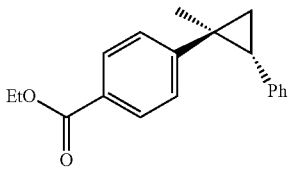

Relative stereochemistry was confirmed by NOESY analysis.

5-(tert-butyl)-1H-indole: Following Example 2, 5-bromo-1H-indole (194 mg, 0.989 mmol) was allowed to react with $^t$BuBr (68 mg, 0.496 mmol) under reductive electrolysis (3 mA, 4 equiv $e^-$). The title compound was isolated following purification by flash column chromatography (3:97 EtOAc:Hexanes) as a yellow oil (52 mg, 0.30 mmol, 60%).

4-methyl-1,4-diphenylpentan-1-one: Following Example 2, bromobenzene (156 mg, 0.994 mmol) was allowed to react with 4-bromo-4-methyl-1-phenylpentan-1-one (127 mg, 0.498 mmol) under reductive electrolysis (3 mA, 4 equiv $e^-$). The title compound was isolated following purification by flash column chromatography 0.5:99.5 EtOAc:Hexanes) as a colorless oil (79 mg, 0.31 mmol, 61%).

N-(4-(tert-butyl)phenyl)-N-methylpicolinamide: Following Example 2, N-(4-bromophenyl)-N-methylpicolinamide (217 mg, 0.745 mmol) was allowed to react with $^t$BuBr (68 mg, 0.50 mmol) under reductive electrolysis (3 mA, 4 equiv $e^-$). The title compound was isolated following purification by flash column chromatography (20:80 EtOAc:Hexanes) as an orange oil (81 mg, 0.30 mmol, 61%).

(E)-3,3-dimethylhex-4-en-1-yl benzoate: Following Example 2, (E)-1-bromoprop-1-ene (125 mg, 1.03 mmol) was allowed to react with 3-bromo-3-methylbutyl benzoate (142 mg, 0.524 mmol) under reductive electrolysis (3 mA, 4 equiv $e^-$). The title compound was isolated as a 2:1 mixture of the title compound and isopentyl benzoate (116 mg total) following purification by flash column chromatography (0.5:99.5 EtOAc:Hexanes) a colorless oil (90 mg, 0.39 mmol, 75%).

N-methyl-N-(4-(4-methyltetrahydro-2H-pyran-4-yl)phenyl)acetamide: Following Example 2, N-(4-bromophenyl)-N-methylacetamide (225 mg, 0.990 mmol) was allowed to react with 4-bromo-4-methyltetrahydro-2H-pyran (90 mg, 0.50 mmol) under reductive electrolysis (3 mA, 4 equiv $e^-$). The title compound was isolated following purification by flash column chromatography (0.5:29.5:71 TEA:EtOAc:Hexanes) as an off-white solid (51 mg, 0.22 mmol, 43%).

(1-phenethylcyclobutyl)benzene: Following a modified Example 3, chlorobenzene (111 mg, 0.986 mmol) was allowed to react with (2-(1-bromocyclobutyl)ethyl)benzene (119 mg, 0.497 mmol) under reductive electrolysis (3 mA, 4.0 equiv $e^-$) at 63° C. The title compound was isolated as a mixture of products following purification by flash column chromatography (0:100) EtOAc:Hexanes) as yellow oil (0.27 mmol, 59% by gas chromatography).

N-methyl-N-(4-((1S)-1-methyl-2-phenylcyclopropyl) phenyl)acetamide: Following a modified Example 2, N-(4-chlorophenyl)-N-methylacetamide (181 mg, 0.986 mmol) was allowed to react with (2-bromo-2-methylcyclopropyl) benzene (105 mg, 0.497 mmol) under reductive electrolysis (2 mA, 2.5 equiv $e^-$). The title compound was isolated following purification by flash column chromatography (22:78 EtOAc:Hexanes) as a yellow mixture of products (0.20 mmol, 41% by gas chromatography).

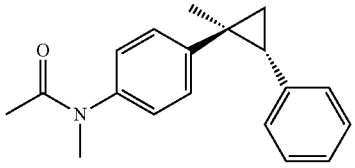

Relative stereochemistry was confirmed by NOESY analysis.

N-(4-((3R,5R,7R)-adamantan-1-yl)phenyl)-N-methylacetamide: Following a modified Example 3, N-(4-chlorophenyl)-N-methylacetamide (184 mg, 1.00 mmol) was allowed to react with 1-bromoadamantane (108 mg, 0.500 mmol) under reductive electrolysis (2 mA, 2.5 equiv $e^-$) at 60° C. The title compound was isolated following purification by flash column chromatography (20:80 EtOAc:Hexanes) as a faint yellow powder (75 mg, 0.26 mmol, 52%).

4-(naphthalen-1-yl)tetrahydro-2H-pyran: Following Example 3, 1-chloronaphthalene (203 mg, 0.980 mmol) was allowed to react with 4-bromotetrahydro-2H-pyran (81 mg, 0.49 mmol) under reductive electrolysis (2 mA, 2.5 equiv $e^-$). The title compound was isolated following purification by flash column chromatography (2% EtOAc:Hexanes) as a white solid (74 mg, 0.35 mmol, 71%).

3-(naphthalen-1-yl)oxetane: Following a modified Example 3, 1-chloronaphthalene (121 mg, 0.744 mmol) was allowed to react with 3-bromooxetane (68 mg, 0.50 mmol) under reductive electrolysis (2 mA, 2.5 equiv $e^-$). The title compound was isolated following purification by flash column chromatography (2:98 EtOAc:Hexanes) as a white solid (62 mg, 0.34 mmol, 68%).

4,4,5,5-tetramethyl-2-(3-(1-phenoxypropan-2-yl)phenyl)-1,3,2-dioxaborolane: Following Example 3, 2-(3-chlorophenyl)-4,4,5,5-tetramethyl-1,3,2-dioxaborolane (239 mg, 1.00 mmol) was allowed to react with (2-bromopropoxy) benzene (132 mg, 0.500 mmol) under reductive electrolysis (2 mA, 2.5 equiv $e^-$). The title compound was isolated following purification by flash column chromatography (2:98 EtOAc:Hexanes) as a yellow oil (118 mg, 0.348 mmol, 70%).

Ethyl 4-(tetrahydro-2H-pyran-4-yl)benzoate: Following a modified Example 3, ethyl 4-chlorobenzoate (139 mg, 0.752 mmol) was allowed to react with 4-bromotetrahydro-2H-pyran (83 mg, 0.50 mmol) under reductive electrolysis (3 mA, 4 equiv $e^-$) at 60° C. The title compound was isolated following purification by flash column chromatography (5:95 EtOAc:Hexanes) as white solid (101 mg, 0.43 mmol, 86%).

1-(3-(tetrahydro-2H-pyran-4-yl)phenyl)propan-1-one: Following Example 3, 1-(3-chlorophenyl)propan-1-one (175 mg, 1.04 mmol) was allowed to react with (24-bromotetrahydro-2H-pyran (86 mg, 0.52 mmol) under reductive electrolysis (3 mA, 4 equiv $e^-$). The title compound was isolated following purification by flash column chromatography (10:90 EtOAc:Hexanes) as a white solid (79 mg, 0.36 mmol, 69%).

4-(tetrahydro-2H-pyran-4-yl)benzonitrile: Following Example 3, 4-chlorobenzonitrile (135 mg, 0.981 mmol) was allowed to react with 4-bromotetrahydro-2H-pyran (84 mg, 0.51 mmol) under reductive electrolysis (2 mA, 2.85 equiv $e^-$). The title compound was isolated following purification by flash column chromatography (3:97 EtOAc:Hexanes) as an off-white solid (71 mg, 0.38 mmol, 74%).

tert-butyl 4-(4-(6-methoxy-3-(2-methoxy-2-oxoethyl)-2-methyl-1H-indole-1-carbonyl)phenyl)piperidine-1-carboxylate: Following a modification of Example 2, ethyl 2-(1-(4-chlorobenzoyl)-6-methoxy-2-methyl-1H-indol-3-yl)acetate (193 mg, 0.500 mmol) was allowed to react with tert-butyl 4-chloropiperidine-1-carboxylate (165 mg, 0.751 mmol) under reductive electrolysis (3 mA, 4 equiv $e^-$). The title compound was isolated following purification by flash column chromatography (15:85 EtOAc:Hexanes) as an off-white solid (146 mg, 0.280 mmol, 56%).

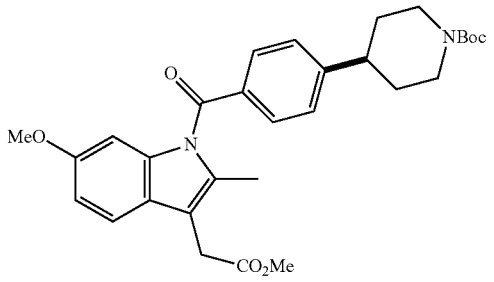

4-([1,1'-biphenyl]-4-yl)tetrahydro-2H-pyran: Following Example 4, [1,1'-biphenyl]-4-yl trifluoromethanesulfonate (304 mg, 1.01 mmol) was allowed to react with 4-bromotetrahydro-2H-pyran (83 mg, 0.502 mmol) under reductive electrolysis (2 mA, 4 equiv $e^-$). The title compound was isolated following purification by flash column chromatography (0.5:99.5 EtOAc:Hexanes) as a white solid. (76 mg, 0.319 mmol, 63%).

4-(naphthalen-2-yl)tetrahydro-2H-pyran: Following Example 4, naphthalen-2-yl trifluoromethanesulfonate (276 mg, 1.00 mmol) was allowed to react with 4-bromotetrahydro-2H-pyran (83 mg, 0.5 mmol) under reductive electrolysis (2 mA, 2.5 equiv $e^-$). The title compound was isolated following purification by flash column chromatography (2.5:97.5 EtOAc:Hexanes) as a colorless oil (87 mg, 0.41 mmol, 82%).

tert-butyl 4-(2-methyl-1-oxo-1,2,8,9-tetrahydro-2,9a-diazabenzo[cd]azulen-6-yl)piperidine-1-carboxylate: Following a modified Example 4, 2-methyl-1-oxo-1,2,8,9-tetrahydro-2,9a-diazabenzo[cd]azulen-6-yl trifluoromethanesulfonate (348 mg, 1.00 mmol) was allowed to react with tert-butyl 4-bromopiperidine-1-carboxylate (132 mg, 0.500 mmol) under reductive electrolysis (1 mA, 2.5 equiv e⁻). The title compound was isolated following purification by flash column chromatography (100% Hexanes) as a yellow resin (64 mg, 0.17 mmol, 34%).

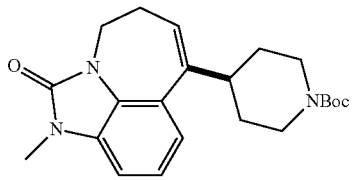

tert-butyl 4-(1,4-dioxaspiro[4.5]dec-7-en-8-yl)piperidine-1-carboxylate: Following Example 4, 1,4-dioxaspiro[4.5]dec-7-en-8-yl trifluoromethanesulfonate (290 mg, 1.01 mmol) was allowed to react with tert-butyl 4-bromopiperidine-1-carboxylate (133 mg, 0.503 mmol) under reductive electrolysis (2 mA, 2.5 equiv $e^-$). The title compound was isolated following purification by flash column chromatography (4:96 EtOAc:Hexanes) as a white solid (64 mg, 0.20 mmol, 39%).

(2-(cyclohex-1-en-1-yl)propoxy)benzene: Following Example 4, cyclohex-1-en-1-yl trifluoromethanesulfonate (239 mg, 1.04 mmol) was allowed to react with (2-bromopropoxy)benzene (109 mg, 0.507 mmol) under reductive electrolysis (2 mA, 2.5 equiv $e^-$). The title compound was isolated following purification by flash column chromatography (0:100 EtOAc:Hexanes) as a colorless oil (90 mg, 0.42 mmol, 82%).

tert-butyl 4-(tetrahydro-2H-pyran-4-yl)-3,6-dihydropyridine-1(2H)-carboxylate: Following Example 4, tert-butyl 4-(((trifluoromethyl)sulfonyl)oxy)-3,6-dihydropyridine-1(2H)-carboxylate (330 mg, 0.99 mmol) was allowed to react with 4-bromotetrahydro-2H-pyran (83 mg, 0.500 mmol) under reductive electrolysis (2 mA, 2.5 equiv $e^-$). The title compound was isolated following purification by flash column chromatography (10:90 EtOAc:Hexanes) as a colorless oil (84 mg, 0.322 mmol, 64%).

8-(1-phenethylcyclobutyl)-1,4-dioxaspiro[4.5]dec-7-ene: Following Example 4, 1,4-dioxaspiro[4.5]dec-7-en-8-yl trifluoromethanesulfonate (288 mg, 1.00 mmol) was allowed to react with ((1-bromocyclobutyl)methyl)benzene (112 mg, 0.500 mmol) under reductive electrolysis (2 mA, 2.5 equiv $e^-$). The title compound was isolated as an inseparable mixture following purification by flash column chromatography (2:98 EtOAc:Hexanes) as a yellow oil (63 mg, 0.22 mmol, 44% based on NMR yield).

tert-butyl 4-(6-methylhepta-1,5-dien-2-yl)piperidine-1-carboxylate: Following Example 4, 6-methylhepta-1,5-dien-2-yl trifluoromethanesulfonate (258 mg, 0.999 mmol) was allowed to react with tert-butyl 4-bromopiperidine-1-carboxylate (132 mg, 0.499 mmol) under reductive electrolysis (2 mA, 2.5 equiv $e^-$). The title compound was isolated following purification by flash column chromatography (4:96 EtOAc:Hexanes) as a colorless oil (92 mg, 0.31 mmol, 62%).

Hydrogenation: To a 20 mL round-bottom flask was added tert-butyl 4-(6-methylhepta-1,5-dien-2-yl)piperidine-1-carboxylate (92 mg, 0.31 mmol) a stir bar, 10% Pd/C (40 mg, 1 equiv) and 10 mL of EtOAc. The reaction mixture was allowed to stir at room temperature under 1 atm of $H_2$ for one hour. The resulting slurry was filtered over Celite and concentrated by rotary evaporation to afford the title compound as a colorless oil. (78 mg, 0.26 mmol, 84%)

((3E,5E)-4-ethyl-2-methylocta-3,5-dien-1-yl)oxy)benzene: Following Example 4, (1E,3E)-2-ethylhexa-1,3-dien-1-yl trifluoromethanesulfonate (250 mg, 1.00 mmol) was allowed to react with (2-bromopropoxy)benzene (108 mg, 0.500 mmol) under reductive electrolysis (2 mA, 2.5 equiv $e^-$). The title compound was isolated following purification by flash column chromatography (100% Hexanes) as a colorless oil (64 mg, 0.26 mmol, 4:1 d.r., 52%).

(1S,4S)-1,7,7-trimethyl-2-(1-phenethylcyclobutyl)bicyclo[2.2.1]hept-2-ene: Following a modified Example 4, (1S,4S)-1,7,7-trimethylbicyclo[2.2.1]hept-2-en-2-yl trifluoromethanesulfonate (170 mg, 0.598 mmol) was allowed to react with (2-(1-bromocyclobutyl)ethyl)benzene (119 mg, 0.498 mmol) under reductive electrolysis (2 mA, 4 equiv $e^-$) at 33° C. The title compound was isolated following purification by flash column chromatography (0:100 EtOAc:Hexanes) as a colorless oil (105 mg, 0.357 mmol, 72%).

tert-butyl 4-((1S,4S)-1,7,7-trimethylbicyclo[2.2.1]hept-2-en-2-yl)piperidine-1-carboxylate: Following Example 4, (1S,4S)-1,7,7-trimethylbicyclo[2.2.1]hept-2-en-2-yl trifluoromethanesulfonate (282 mg, 0.991 mmol) was allowed to react with tert-butyl 4-bromopiperidine-1-carboxylate (131 mg, 0.496 mmol) under reductive electrolysis (2 mA, 4 equiv $e^-$). The title compound was isolated following purification by flash column chromatography (2:98 EtOAc:Hexanes) as a white solid (87 mg, 0.27 mmol, 57%).

tert-butyl 4-((3R,6S)-6-isopropyl-3-methylcyclohex-1-en-1-yl)piperidine-1-carboxylate: Following Example 4, (3R,6S)-6-isopropyl-3-methylcyclohex-1-en-1-yl trifluoromethanesulfonate (286 mg, 1.00 mmol) was allowed to react with tert-butyl 4-bromopiperidine-1-carboxylate (132 mg, 0.500 mmol) under reductive electrolysis (2 mA, 2.5 equiv $e^-$). The title compound was isolated following purification by flash column chromatography (10:90 EtOAc:Hexanes) as a colorless oil (114 mg, 0.355 mmol, 71%).

tert-butyl 4-((2S,6'R)-4-chloro-2',5,7-trimethoxy-6'-methyl-3-oxo-3H-spiro[benzofuran-2,1'-cyclohexane]-2',4'-dien-4'-yl)piperidine-1-carboxylate; Following a modified version of Example 3, (2S,6'R)-4-chloro-2',5,7-trimethoxy-6'-methyl-3-oxo-3H-spiro[benzofuran-2,1'-cyclohexane]-2',4'-dien-4'-yl trifluoromethanesulfonate (194 mg, 0.400 mmol) was allowed to react with tert-butyl 4-bromopiperidine-1-carboxylate (158 mg, 0.598 mmol) under reductive electrolysis (2 mA, 4 equiv $e^-$). The title compound was isolated following purification by flash column chromatography (15:85 EtOAc:Hexanes) as a yellow solid (71 mg, 0.14 mmol, 34%).

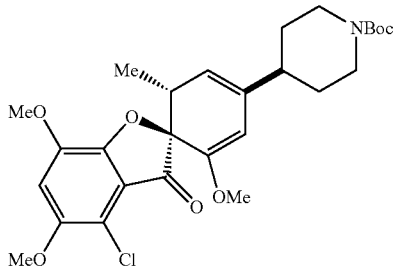

tert-butyl 4-(3-isopropyl-1H-indol-5-yl)piperidine-1-carboxylate: Following a modified Example 3, 5-bromo-3-isopropyl-1H-indole (238 mg, 1.00 mmol) was allowed to react with tert-butyl 4-bromopiperidine-1-carboxylate (132 mg, 328 mmol) under reductive electrolysis (3 mA, 2.5 equiv e) at 40° C. The title compound was isolated following purification by flash column chromatography (25:75) EtOAc:Hexanes) as a colorless solid (102 mg, 0.298 mmol, 60%).

3-isopropyl-5-(tetrahydro-2H-pyran-4-yl)-1H-indole: Following a modified Example 3, 5-bromo-3-isopropyl-1H-indole (238 mg, 1.00 mmol) was allowed to react with 4-bromotetrahydro-2H-pyran (82 mg, 0.50 mmol) under reductive electrolysis (3 mA, 2.5 equiv $e^-$) at 40° C. The title compound was isolated following purification by flash column chromatography (15:85) EtOAc:Hexanes) as a colorless solid (55 mg, 0.23 mmol, 45%).

N,N-dimethyl-4-(oxetan-3-yl)aniline: Following a modified Example 3, 4-bromo-N,N-dimethylaniline (199 mg, 0.99 mmol) was allowed to react with 3-bromooxetane (68 mg, 0.50 mmol) under reductive electrolysis (3 mA, 2.5 equiv e) at 40° C. The title compound was isolated following purification by flash column chromatography (5:95) EtOAc:Hexanes) as a colorless solid (42 mg, 0.24 mmol, 47%).

N,N-dimethyl-4-(3-phenylpropyl)aniline: Following a modified Example 3, 4-bromo-N,N-dimethylaniline (201 mg, 1.01 mmol) was allowed to react with (3-bromopropyl) benzene (99 mg, 0.50 mmol) under reductive electrolysis (3 mA, 2.5 equiv $e^-$) at 60° C. The title compound was isolated following purification by flash column chromatography (3:97) EtOAc:Hexanes) as a colorless oil (78 mg, 0.33 mmol, 65%).

1,3-diphenylpropane: Following a modified Example 3, bromobenzene (157 mg, 1.00 mmol) was allowed to react with (3-bromopropyl)benzene (mg, mmol) under reductive electrolysis (3 mA, 2.5 equiv e) at 60° C. The title compound was confirmed by GCMS and quantified by gas chromatography, 47%.

ethyl 4-(3-phenylpropyl)benzoate: Following a modified Example 3, ethyl 4-bromobenzoate (229 mg, 1.00 mmol) was allowed to react with (3-bromopropyl)benzene (99 mg, 0.50 mmol) under reductive electrolysis (3 mA, 2.5 equiv $e^-$) at 60° C. The title compound was confirmed by GCMS and quantified by gas chromatography, 36%.

N-methyl-N-(4-(tetrahydro-2H-pyran-4-yl)phenyl)acetamide: Following a modified Example 3, N-(4-bromophenyl)-N-methylacetamide (230 mg, 1.00 mmol) was allowed to react with 4-bromotetrahydro-2H-pyran (mg, mmol) under reductive electrolysis (3 mA, 2.5 equiv $e^-$) at 40° C. The title compound was isolated following purification by flash column chromatography (5:95) EtOAc:Hexanes) as a faint yellow solid (57% by gas chromatography).

1-(3-phenylpropyl)naphthalene: Following a modified Example 3, 1-chloronaphthalene (mg, mmol) was allowed to react with (3-bromopropyl)benzene (mg, mmol) under reductive electrolysis (3 mA, 2.5 equiv e) at 60° C. The title compound was isolated as a mixture of products following purification by flash column chromatography (0:100) EtOAc:Hexanes) as a colorless oil (42% yield by gas chromatography).

4-neopentyl-1,1'-biphenyl: Following a modified Example 4, [1,1'-biphenyl]-4-yl trifluoromethanesulfonate (302 mg, 1.00 mmol) was allowed to react with 1-bromo-2,2-dimethylpropane (76 mg, 0.51 mmol) under reductive electrolysis (3 mA, 2.5 equiv $e^-$) at 60° C. The title compound was isolated as a mixture of products following purification by flash column chromatography (0:100) EtOAc:Hexanes) as a colorless oil (41% yield by gas chromatography).

(3R,5R,7R)-1-([1,1'-biphenyl]-4-yl)adamantane: Following a modified Example 4, [1,1'-biphenyl]-4-yl trifluoromethanesulfonate (302 mg, 1.00 mmol) was allowed to react with (3S,5S,7S)-1-bromoadamantane (108 mg, 0.500 mmol) under reductive electrolysis (3 mA, 2.5 equiv $e^-$) at 60° C. The title compound was isolated as a mixture of products following purification by flash column chromatography (0:100) EtOAc:Hexanes) as a colorless oil (55% yield by gas chromatography).

1-methoxy-4-(1-phenoxypropan-2-yl)benzene: Following a modified Example 3, 1-bromo-4-methoxybenzene (107 mg, 0.497 mmol) was allowed to react with (2-bromopropoxy)benzene (116 mg, 0.620 mmol) under reductive electrolysis (3 mA, 2.5 equiv $e^-$) at 25° C. The title compound was isolated following purification by flash column chromatography (2:98) EtOAc:Hexanes) as a colorless oil (87 mg, 0.36 mmol, 72%).

6-(tetrahydro-2H-pyran-4-yl)quinoline: Following a modified Example 3, 6-bromoquinoline (104 mg, 0.500 mmol) was allowed to react with 4-bromotetrahydro-2H-pyran (83 mg, 0.50 mmol) under reductive electrolysis (3 mA, 2.5 equiv $e^-$) at 25° C. The title compound was isolated as a mixture of products following purification by flash column chromatography (5:95) EtOAc:Hexanes) as a yellow oil (54 mg, 0.25 mmol, 51%).

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. Further, while only certain representative compositions and method steps disclosed herein are specifically described, other combinations of the compositions and method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed. Other than in the examples, or where otherwise noted, all numbers expressing quantities of ingredients, reaction conditions, and so forth used in the specification and claims are to be understood at the very least, and not as an attempt to limit the application of the doctrine of equivalents to the scope of the claims, to be construed in light of the number of significant digits and ordinary rounding approaches.

What is claimed is:

1. A process for forming a compound of Formula (I):

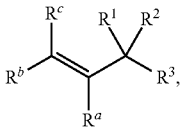

wherein $R^a$ is selected from hydrogen, $C_{1-12}$alkyl, aryl, $C_{1-12}$heteroaryl, $C_{3-12}$cycloalkyl, or $C_{1-12}$ heterocyclyl;

wherein $R^b$ is selected from hydrogen, $C_{1-12}$alkyl, aryl, $C_{1-12}$heteroaryl, $C_{3-12}$cycloalkyl, or $C_{1-12}$ heterocyclyl;

wherein $R^c$ is selected from hydrogen, $C_{1-12}$alkyl, aryl, $C_{1-12}$heteroaryl, $C_{3-12}$cycloalkyl, or $C_{1-12}$ heterocyclyl;

wherein $R^1$ is selected from $C_{1-12}$alkyl, aryl, $C_{1-12}$heteroaryl, $C_{3-12}$cycloalkyl, or $C_{1-12}$ heterocyclyl;

wherein $R^2$ is selected from $C_{1-12}$alkyl, aryl, $C_{1-12}$heteroaryl, $C_{3-12}$cycloalkyl, or $C_{1-12}$ heterocyclyl;

wherein $R^3$ is selected from hydrogen, $C_{1-12}$alkyl, aryl, $C_{1-12}$heteroaryl, $C_{3-12}$cycloalkyl, or $C_{1-12}$ heterocyclyl;

wherein any two or more of $R^a$, $R^b$, $R^c$, $R^1$, $R^2$, and $R^3$ may together form a ring;

comprising electrolyzing a mixture of:

a) an $sp^2$ donor of Formula (a):

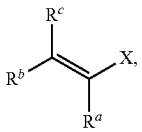

wherein X is F, Cl, Br, I, $OSO_2R$, OC(=O)R, $B(OH)_2$, $BF_3$, $BR_2$, $B(OR)_2$, $B(OC(=O)R)_2$, $B(NHR)_2$, $B(OR)_3$, wherein R is in each case independently selected from $C_{1-8}$alkyl, aryl, $C_{1-8}$-cycloalkyl, $C_{1-8}$heterocyclyl, and $C_{1-8}$heteroaryl, each R optionally substituted one or more times by F, Cl, Br, I, $NO_2$, and wherein two or more R groups may together form a ring;

b) an $sp^3$ donor of Formula (b):

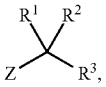

wherein Z is F, Cl, Br, I, $OSO_2R$, OC(=O)R, $B(OH)_2$, $BF_3$, $BR_2$, $B(OR)_2$, $B(OC(=O)R)_2$, $B(NHR)_2$, $B(OR)_3$, wherein R is in each case independently selected from $C_{1-8}$alkyl, aryl, $C_{1-8}$-cycloalkyl, $C_{1-8}$heterocyclyl, and $C_{1-8}$heteroaryl, each R optionally substituted one or more times by F, Cl, Br, I, $NO_2$, and wherein two or more R groups may together form a ring;

c) a catalyst system comprising:

i) a transition metal selected from Ni, Mn, Fe, Cu, Co, or a combination thereof;

ii) a tridentate ligand; and iii) a tertiary organophosphine.

2. The process according to claim 1, wherein the electrolyzing comprises supplying an electric current from 1-10 mA.

3. The process according to claim 1, wherein the electrolyzing provides from 3-10 equivalent e, based on the molar amount of the $sp^3$ donor of Formula (b).

4. The process according to claim 1, wherein the tridentate ligand has the formula:

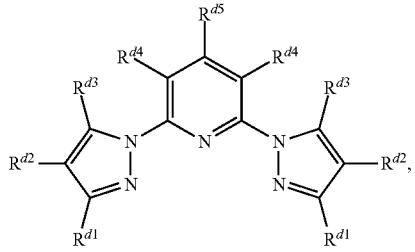

wherein $R^{d1}$ is selected from H, F, Cl, Br, I, $C_{1-3}$alkyl, $C_{1-8}$haloalkyl, $OC_{1-3}$alkyl, $OC_{1-3}$ haloalkyl, $R^{d2}$ is selected from H, F, Cl, Br, I, $C_{1-3}$alkyl, $C_{1-3}$haloalkyl, $OC_{1-3}$alkyl, $OC_{1-3}$haloalkyl, $R^{d3}$ is selected from H, F, Cl, Br, I, $C_{1-3}$alkyl, $C_{1-3}$haloalkyl, $OC_{1-3}$alkyl, $OC_{1-3}$haloalkyl, $R^{d4}$ is selected from H, F, Cl, Br, I, $C_{1-3}$alkyl, $C_{1-3}$haloalkyl, $OC_{1-3}$alkyl, $OC_{1-3}$haloalkyl, and $R^{d5}$ is selected from H, F, Cl, Br, I, $C_{1-3}$alkyl, $C_{1-3}$haloalkyl, $OC_{1-3}$alkyl, $OC_{1-8}$haloalkyl, wherein any two or more of $R^{d1}$, $R^{d2}$, $R^{d3}$, $R^{d4}$, and $R^{d5}$ may together form a ring.

5. The process according to claim 1, wherein the tertiary organophosphine has the formula:

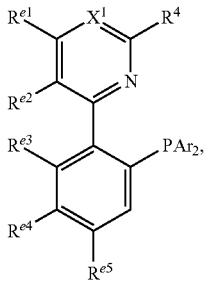

wherein, $X^1$ is N or $CR^5$, wherein $R^5$ is H, $C_{1-4}$alkyl, or $OC_{1-4}$alkyl, Ar is in each case selected from aryl and $C_{1-12}$heteroaryl, $R^4$ is H or $C_{1-6}$alkyl;

$R^{e1}$ is selected from H, F, Cl, Br, I, $C_{1-3}$alkyl, $C_{1-3}$haloalkyl, $OC_{1-3}$alkyl, $OC_{1-3}$haloalkyl, $R^{e2}$ is selected from H, F, Cl, Br, I, $C_{1-3}$alkyl, $C_{1-8}$haloalkyl, $OC_{1-3}$alkyl, $OC_{1-3}$haloalkyl, $R^{e3}$ is selected from H, F, Cl, Br, I, $C_{1-3}$alkyl, $C_{1-3}$haloalkyl, $OC_{1-3}$alkyl, $OC_{1-3}$haloalkyl, and $R^{e4}$ is selected from H, F, Cl, Br, I, $C_{1-3}$alkyl, $C_{1-3}$haloalkyl, $OC_{1-3}$alkyl, $OC_{1-3}$haloalkyl, $R^{e5}$ is selected from H, F, Cl, Br, I, $C_{1-3}$alkyl, $C_{1-8}$haloalkyl, $OC_{1-3}$alkyl, $OC_{1-3}$haloalkyl, wherein any two or more of $R^{e1}$, $R^{e2}$, $R^{e3}$, $R^{e4}$, and $R^{e5}$ may together form a ring.

6. The process according to claim 5, wherein $X^1$ is N.

7. The process according to claim 5, wherein Ar is in each case optionally substituted phenyl.

8. The process according to claim 5, wherein Ar is in each case unsubstituted phenyl.

9. The process according to claim 5, wherein $R^{e1}$ and $R^{e2}$ together form an aromatic ring.

10. The process according to claim 5, wherein $R^{e3}$ and $R^{e4}$ together form an aromatic ring.

11. The process according to claim 1, wherein the tridentate ligand is present in an amount of 0.1-25 mol %, relative to the $sp^3$ donor.

12. The process according to claim 1, wherein the tertiary organophosphine is present in an amount of 0.1-25 mol %, relative to the $sp^3$ donor.

13. The process according to claim 1, wherein the tridentate ligand and tertiary organophosphine are present in the same molar amount.

14. The process according to claim 1, wherein the tridentate ligand is present in a molar excess relative to the tertiary organophosphine.

15. The process according to claim 1, wherein the tertiary organophosphine is present in a molar excess relative to the tridentate ligand.

16. The process according to claim 1, wherein the transition metal is present in an amount of 0.1-25 mol %, relative to the $sp^3$ donor.

17. The process according to claim 1, wherein the transition metal comprises a mixture of nickel and manganese.

18. The process according to claim 17, wherein the transition metal comprises a mixture of nickel and manganese in an equimolar amount.

19. The process according to claim 1, wherein the transition metal consists essentially of nickel.

20. The process according to claim 1, wherein X is Cl, Br, $OSO_2CH_3$, $OSO_2CF_3$, or $OSO_2C$ (4-methylphenyl), or:

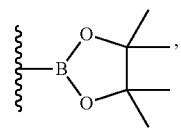

,

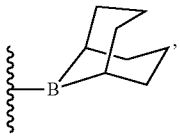

,

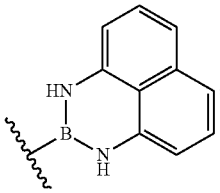

,

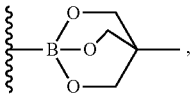

, or

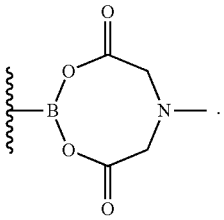

.

* * * * *